US011085610B2

(12) United States Patent
Yaphe et al.

(10) Patent No.: US 11,085,610 B2
(45) Date of Patent: Aug. 10, 2021

(54) LUMINAIRE AND OUTPUT ELEMENT COUPLING MECHANISM THEREFOR

(71) Applicant: Axis Lighting Inc., Lasalle (CA)

(72) Inventors: Howard Yaphe, Lasalle (CA); Christianne Leblanc, Montreal (CA); Sebastien Bire, Montreal (CA); Andrew Miles, Lasalle (CA)

(73) Assignee: AXIS LIGHTING INC., Lasalle (CA)

( * ) Notice: Subject to any disclaimer, the term of this patent is extended or adjusted under 35 U.S.C. 154(b) by 0 days.

(21) Appl. No.: 16/515,874

(22) Filed: Jul. 18, 2019

(65) Prior Publication Data

US 2019/0338932 A1 Nov. 7, 2019

Related U.S. Application Data

(63) Continuation of application No. 15/241,527, filed on Aug. 19, 2016, now Pat. No. 10,393,353, which is a (Continued)

(30) Foreign Application Priority Data

Sep. 30, 2013 (CA) ..... CA 2828845

(51) Int. Cl.
*F21V 21/00* (2006.01)
*F21V 5/04* (2006.01)

(Continued)

(52) U.S. Cl.
CPC ..... *F21V 5/04* (2013.01); *F21V 3/00* (2013.01); *F21V 15/01* (2013.01); *F21V 17/164* (2013.01);

(Continued)

(58) Field of Classification Search
CPC ..... F21V 21/04–049; F21V 13/04; F21V 13/045; F21V 13/06; F21V 13/12; F21V 13/14

(Continued)

(56) References Cited

U.S. PATENT DOCUMENTS 2,545,119 A 3/1951 Stratton et al.
3,919,542 A 11/1975 Castic (Continued)

FOREIGN PATENT DOCUMENTS

WO WO 2012/156859 11/2012

OTHER PUBLICATIONS

U.S. Office Action dated Oct. 24, 2014 issued in U.S. Appl. No. 13/763,322.

(Continued)

*Primary Examiner* — Gerald J Sufleta, II
(74) *Attorney, Agent, or Firm* — Barnes & Thornburg LLP

(57) ABSTRACT

Described are various embodiments of a luminaire and output element coupling mechanism therefor. In one embodiment, a recessable luminaire comprises two or more luminaire modules, each one of which comprising a recessable housing having opposed side walls. The luminaire further comprises an output element securable along and between these side walls to at least partially define an output of the luminaire, and opposed inwardly biased output coupling structures extending at least partially along respective side walls and adapted to receive and resiliently secure corresponding edges of the output element therein.

20 Claims, 17 Drawing Sheets

Related U.S. Application Data continuation of application No. 14/184,511, filed on Feb. 19, 2014, now Pat. No. 9,441,814, which is a continuation-in-part of application No. 13/763,322, filed on Feb. 8, 2013, now abandoned.

(51) Int. Cl.

| | |
|---|---|
| ***F21V 15/01*** | (2006.01) |
| ***F21V 21/04*** | (2006.01) |
| ***F21V 3/00*** | (2015.01) |
| ***F21V 17/16*** | (2006.01) |
| *F21Y 115/10* | (2016.01) |

(52) U.S. Cl.
CPC ..... *F21V 21/041* (2013.01); *F21V 21/049* (2013.01); *F21Y 2115/10* (2016.08)

(58) Field of Classification Search
USPC ..... 362/368, 370, 375
See application file for complete search history.

(56) References Cited

U.S. PATENT DOCUMENTS 4,138,716 A 2/1979 Muhlethaler et al.
4,410,931 A 10/1983 DeCandia et al.
5,119,282 A 6/1992 Meyer et al.
5,245,518 A 9/1993 Aspenwall
5,448,460 A 9/1995 Belfer et al.
5,452,187 A 9/1995 Belfer et al.
5,574,600 A 11/1996 Agro
5,583,583 A 12/1996 Wilson
5,609,414 A 3/1997 Caluori
6,152,573 A 11/2000 Mitchell
6,220,317 B1 4/2001 Martin et al.
6,267,491 B1 7/2001 Parrigin
6,421,904 B1 7/2002 Wedekind et al.
6,698,103 B2 3/2004 Nortier et al.
6,702,453 B2 3/2004 Weedon
6,926,477 B2 8/2005 Allemann et al.
6,979,107 B1 * 12/2005 Benensohn ..... F21S 8/02 362/133
7,086,171 B2 8/2006 Lawson
7,114,826 B1 10/2006 Lilly
7,210,827 B1 * 5/2007 Haddad ..... F21V 19/04 362/375
7,293,895 B2 11/2007 Grossman et al.
7,363,720 B2 4/2008 DiGavero et al.
7,399,104 B2 * 7/2008 Rappaport ..... F21S 8/02 362/147
7,497,025 B2 3/2009 Murray
7,611,269 B1 11/2009 Lyons
7,806,550 B2 * 10/2010 Tyson ..... E01F 9/559 362/153
8,118,455 B2 2/2012 Cowan et al.
8,684,568 B2 * 4/2014 Nagaoka ..... F21V 17/12 362/374
9,140,435 B2 9/2015 Yaphe et al.
9,441,814 B2 9/2016 Yaphe et al.
2003/0115767 A1 6/2003 Wedekind et al.
2005/0217129 A1 10/2005 Boys
2006/0098307 A1 5/2006 Campean
2006/0164844 A1 7/2006 To
2008/0062705 A1 * 3/2008 Czech ..... F21V 21/30 362/364
2008/0247171 A1 * 10/2008 Tyson ..... F21V 17/20 362/299
2011/0068711 A1 * 3/2011 Spiro ..... F21V 29/67 315/307
2011/0157901 A1 * 6/2011 Chen ..... F21V 17/164 362/373
2011/0222291 A1 * 9/2011 Peng ..... F21V 21/02 362/294
2011/0297971 A1 * 12/2011 Shimizu ..... F21V 13/04 257/88
2012/0051050 A1 3/2012 Lee et al.
2012/0106176 A1 * 5/2012 Lopez ..... F21K 9/00 362/382
2012/0120645 A1 * 5/2012 Hawkins ..... F21S 8/02 362/225
2012/0257383 A1 * 10/2012 Zhang ..... F21S 2/005 362/235
2012/0262902 A1 * 10/2012 Pickard ..... F21S 8/026 362/84
2012/0287628 A1 11/2012 Markell
2013/0010476 A1 * 1/2013 Pickard ..... F21V 13/14 362/311.03
2013/0021777 A1 * 1/2013 Pickard ..... F21V 7/30 362/84
2013/0094225 A1 * 4/2013 Leichner ..... F21S 4/28 362/368
2013/0229788 A1 * 9/2013 Hoffmann ..... F24C 15/102 362/92
2013/0271986 A1 * 10/2013 Rempel ..... F21S 8/026 362/249.02
2013/0308319 A1 * 11/2013 Zhang ..... F21S 8/02 362/311.01
2014/0223753 A1 8/2014 Yaphe et al.
2014/0226327 A1 8/2014 Yaphe et al.
2014/0233229 A1 8/2014 Yaphe et al.
2014/0237836 A1 8/2014 Yaphe et al.
2016/0356463 A1 12/2016 Yaphe et al.

OTHER PUBLICATIONS

U.S. Final Office Action dated Jun. 10, 2015 issued in U.S. Appl. No. 13/763,322.
U.S. Office Action dated Jan. 15, 2016 issued in U.S. Appl. No. 14/184,511.
U.S. Notice of Allowance dated May 13, 2016 issued in U.S. Appl. No. 14/184,511.
U.S. Notice of Allowance dated Jul. 15, 2016 issued in U.S. Appl. No. 14/184,511.
U.S. Office Action dated Jun. 28, 2018 issued in U.S. Appl. No. 15/241,527.
U.S. Office Action dated Nov. 27, 2018 issued in U.S. Appl. No. 15/241,527.
U.S. Notice of Allowance dated Apr. 15, 2019 issued in U.S. Appl. No. 15/241,527.
Winona Lighting catalog "decorative Full Circle", http://www.hokproductdesign.com/myos/my-uploads/2011/07/21/full-circlebrochure.pdf, Jul. 21, 2011.

* cited by examiner

LUMINAIRE AND OUTPUT ELEMENT COUPLING MECHANISM THEREFOR

INCORPORATION BY REFERENCE

An Application Data Sheet is filed concurrently with this specification as part of the present application. Each application that the present application claims benefit of or priority to as identified in the concurrently filed Application Data Sheet is incorporated by reference herein in its entirety and for all purposes.

FIELD OF THE DISCLOSURE

The present disclosure relates to lighting, and in particular, to a luminaire and output element coupling mechanism therefor.

BACKGROUND

Luminaires come in various shapes and sizes and are used in different applications to provide illumination, be it in a commercial, industrial, residential and/or specialized setting. In general, a luminaire will include a housing, one or more light sources operatively mounted therein, and an output element disposed relative to the light source(s) to shape, redirect, or even mask an output to provide a desired output illumination.

Different assemblies are provided to accommodate different installations, for instance in allowing for different output element configurations and installation sequences, as described in the following exemplary documents: U.S. Pat. No. 5,574,600 for a Light Assembly having Interconnected Housing Parts and a Lens; U.S. Pat. No. 6,267,491 for a Lens Retention Means for Vehicle Lamp Assembly; U.S. Pat. No. 5,609,414 for a Recessed Lighting Fixture; U.S. Pat. No. 4,410,931 for a Retention Device for Lighting Fixture Cover; U.S. Pat. No. 4,138,716 for a Lighting Fixture Enclosure; International Application Publication No. WO 2012/156859 for a Lens Retention Clip for Luminaire; and U.S. Pat. No. 5,119,282 for a Reflector Lamp Assembly Utilizing Lens that Snaps into Reflector.

This background information is provided to reveal information believed by the applicant to be of possible relevance. No admission is necessarily intended, nor should be construed, that any of the preceding information constitutes prior art.

SUMMARY

Some aspects of this disclosure provide a luminaire and output element coupling mechanism therefor that overcome some of the drawbacks of known techniques, or at least, provides the public with a useful alternative. For example, different embodiments of the herein described invention(s) provide improvements over and/or alternatives to the state in art in accommodating coupling of an output element to a luminaire housing via a favorable coupling mechanism conducive to such coupling.

In accordance with one aspect, there is provided a luminaire comprising: a housing having opposed side walls for housing one or more light sources therein; an output element securable between said side walls to extend along said housing in at least partially defining a luminaire output; and a resilient coupling flange extending at least partially along at least one of said side walls, said coupling flange having defined along a length thereof an output coupling structure adapted to laterally receive and resiliently secure an edge of said output element therein, said output coupling structure being inwardly biased so to be resiliently retractable and deployable in receiving and securing said edge therein.

In accordance with another aspect, there is provided a luminaire assembly for recessed installation within a correspondingly shaped aperture, comprising: two or more luminaire modules mountable end-to-end within the aperture, each one of which comprising a recessable housing having opposed side walls; an output element securable along and between said side walls to at least partially define an output of the luminaire; and opposed inwardly biased output coupling structures extending at least partially along respective side walls and adapted to receive and resiliently secure corresponding edges of said output elements along said side walls.

In accordance with another aspect, there is provided a luminaire assembly comprising: two or more luminaire modules, each one of which comprising a housing having opposed side walls that, when interconnected, define a combined luminaire pattern; an output element shaped in accordance with said luminaire pattern and having substantially flat edges, said flat edges securable along and between said side walls to at least partially define an output of the luminaire; and opposed inwardly biased output coupling structures extending at least partially along said side walls, wherein said coupling structures are retractable to receive said edges, and resiliently deployable to secure said edges once received.

Other aims, objects, advantages, aspects and features of the disclosure will become more apparent upon reading of the following non-restrictive description of specific embodiments, given by way of example only with reference to the accompanying drawings.

BRIEF DESCRIPTION OF THE FIGURES

Several embodiments of the present disclosure will be provided, by way of examples only, with reference to the appended drawings, wherein:

FIG. 2 is a partial perspective view of an end-to-end coupling between adjacent luminaire modules, in accordance with one embodiment of the invention;

DETAILED DESCRIPTION

With reference to the disclosure herein and the appended figures, a luminaire and output element coupling mechanism therefor will now be described, in accordance with different embodiments of the invention.

Figure 1A:
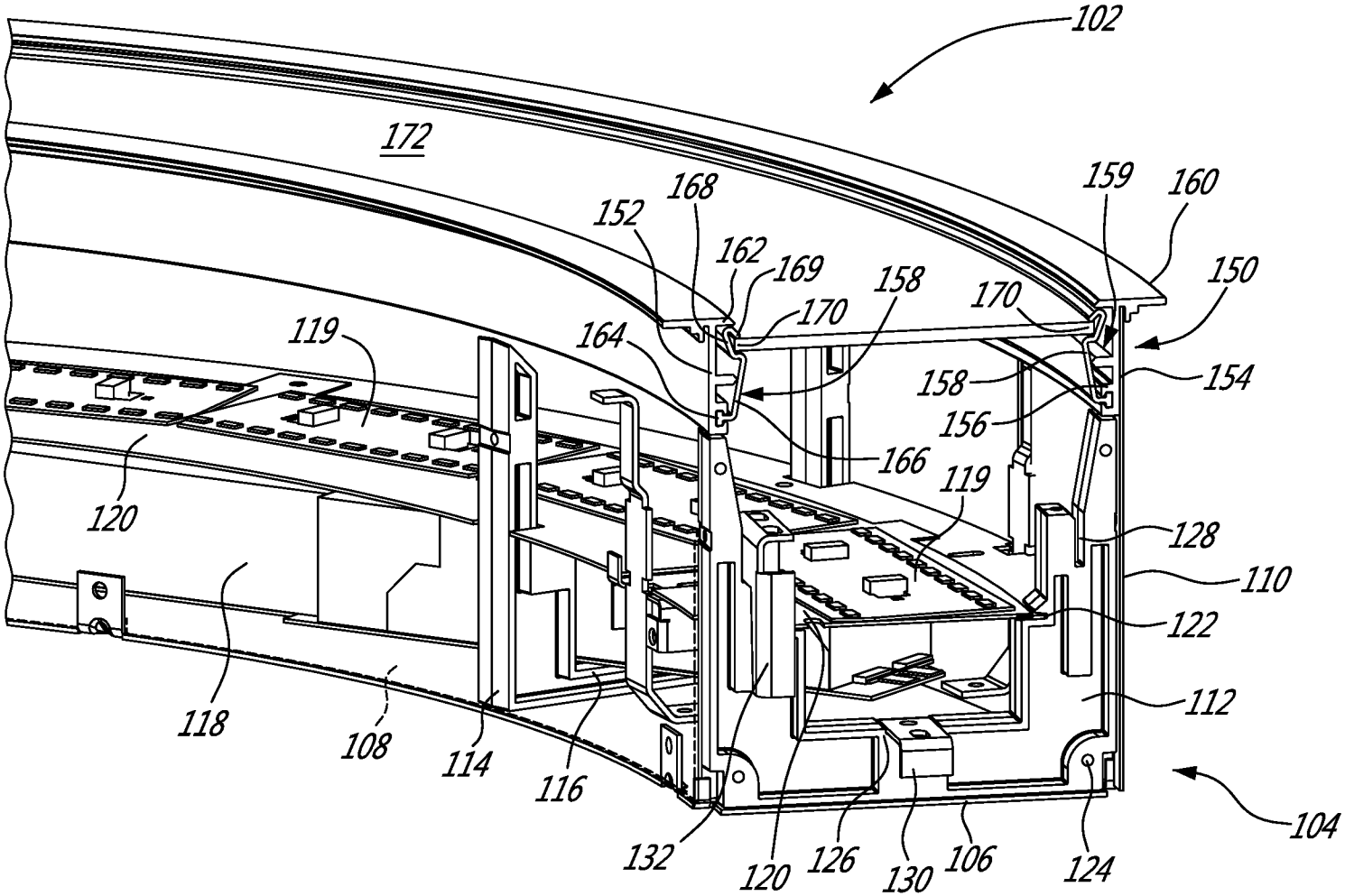
FIGS. 1A and 1B are top and bottom perspective views of a curved luminaire module, in accordance with one embodiment of the invention.
Figure 1B:
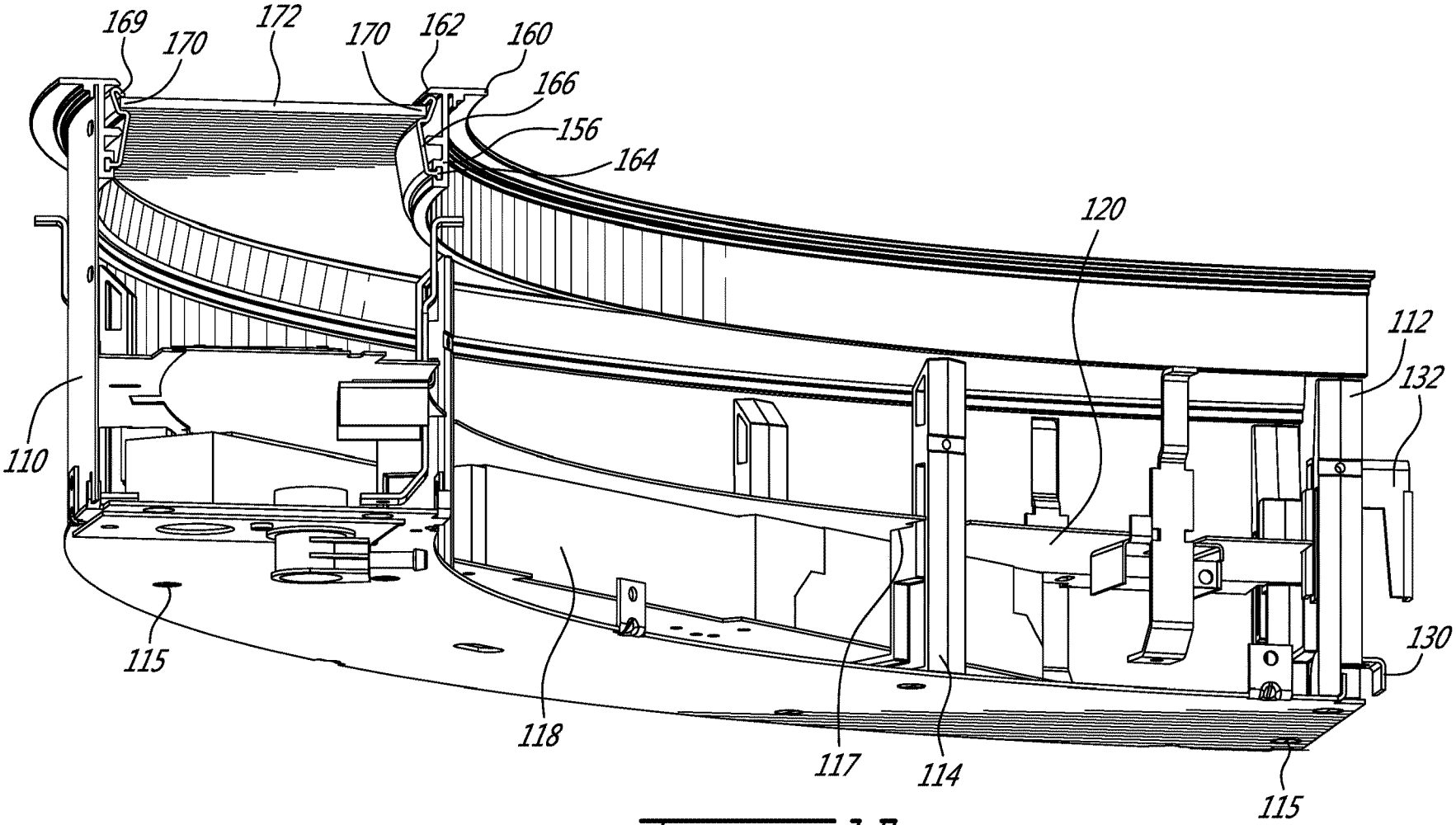
Figure 7:
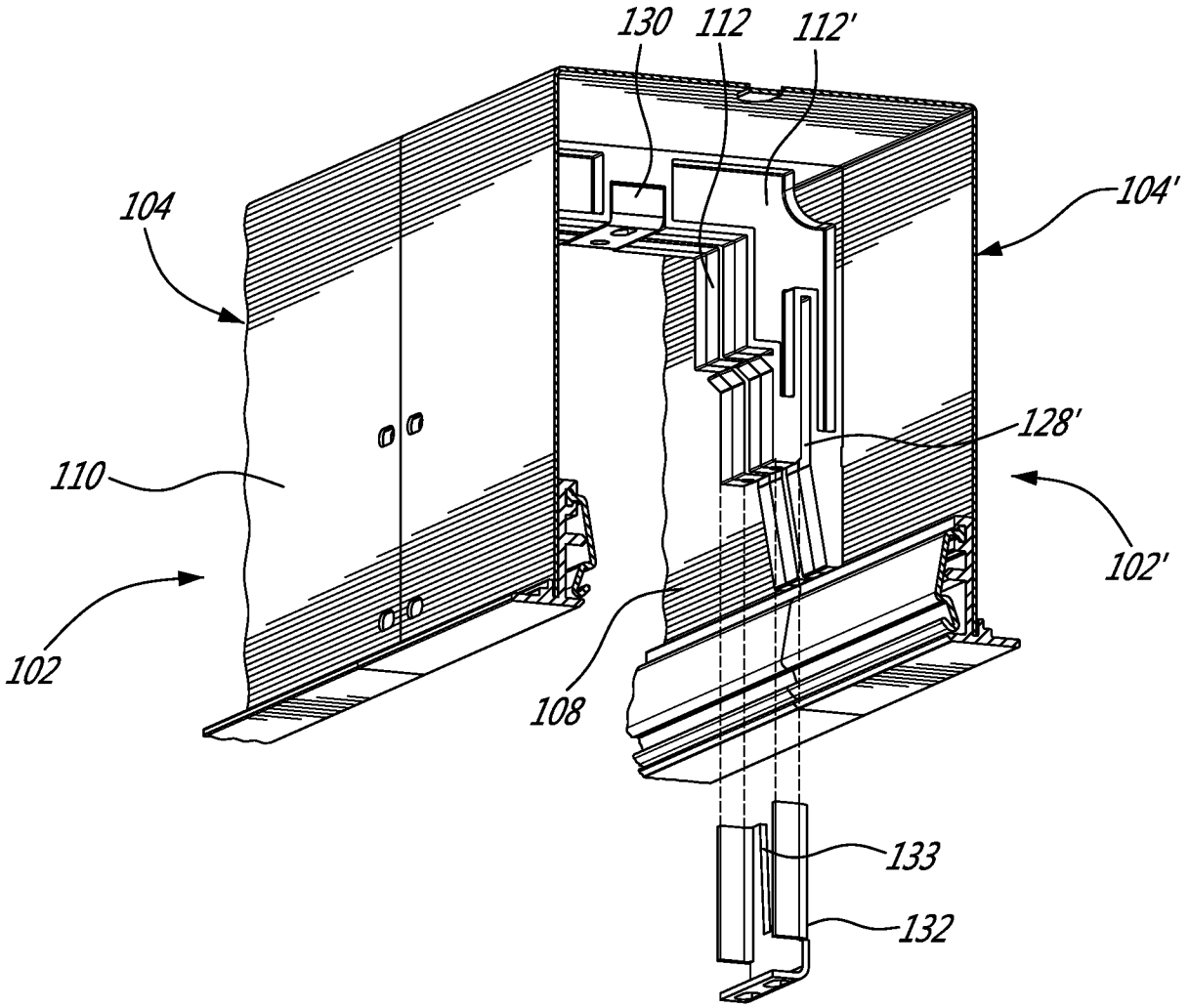
FIGS. 7A to 7G are sequential perspective views of a method for outlining and installing a recessed closed-loop luminaire within a false ceiling surface material; in accordance with one embodiment of the invention.

With reference to FIGS. 1A and 1B, and in accordance one embodiment, a luminaire, in this embodiment comprising a curved luminaire module 102 adapted for end-to-end mounting adjacent similar luminaire modules in the formation of an assembled luminaire output pattern, will now be described. The module 102 generally comprises a housing 104 formed of a base 106 and opposed inner (shown in transparency) and outer side walls 108 and 110, respectively, secured to one another in a generally arcuate box-like formation. The housing 104 generally houses one or more light sources, in this embodiment consisting of a series of light-emitting diode (LED) boards 119, directed toward an output of the luminaire, in this embodiment consisting of an output element 172 such as a flat output lens, filter, diffuser or window, to name a few examples.

In this particular embodiment, a box-like housing is assembled form distinct wall segments, which may be manufactured of a rigid material such as steel, aluminum or another metal/alloy, or again of a solid plastic or other such material. Other constructions may also be considered, such as a U-shaped metal and/or plastic extrusion, and the like, as will be readily appreciated by the skilled artisan. Furthermore, while the illustrated embodiment provides a series of LED boards 119 having parallel lengthwise LED series operatively disposed thereon, other types of light sources, be they operatively mounted in series or as distinct light sources, may also be considered without departing from the general scope and nature of the present disclosure. For example, different LED board configurations and/or technologies may be considered depending on the application and physical configuration at hand, as can other unitary LED light sources and/or other light source types (e.g. fluorescent lights, incandescent lights, etc.) be considered to provide similar results. Namely, various aspects and features of the herein described embodiments are not to be construed as limited to LED-based light sources, as other types of light sources may be readily operated within the context of the herein described embodiments. These and other such alternatives will be readily apparent to the person of ordinary skill in the art, and are therefore intended to fall within the general context of the present disclosure.

In the illustrated embodiment, the housing 104 is fitted with a series of end and interior support structures 112 and 114, respectively, each aligned along the base plate 106 via datum pairs 115 and fastened (e.g. riveted) in place along inner and outer side walls 108, 110. The interior support structures 114 provide structural rigidity to the housing 104, and include a stepped inner profile defining a base portion 116 and opposed intermediate steps 117. An internal LED driver housing 118 is rested across the base portion 116, in which various LED board driving and/or wiring components (not shown) may be disposed to power and drive the LED boards 119. A board plate 120, doubling as a support plate and heat sink for the series of LED boards 119, is rested on and fastened to the opposed intermediate steps 117, and also serves as a cover for housing 118.

The end support structures 112, which also provide structural rigidity to the housing 104, further include a notched step profile (i.e. opposed notched steps 122) shaped to receive snap-engagement of the board plate 120 therein. The end support structures 112 are further configured to provide fastening apertures 124 in accommodating installation of an end cap (not shown), as well as provide endwise coupling features 126, 128 for the end-to-end coupling of adjacent luminaire modules.

For instance, and with added reference to FIG. 2, the base coupling feature 126 is defined by a recessed surface shaped to receive nested and fastened therein a portion of a U-shaped coupler 130 provided in securing adjacent base coupling features of adjacent modules 102, 102'. Lateral coupling features 128 are defined in either side of the end support structure 112 and, when aligned with respective adjacently disposed features 128', define in combination an outwardly angled U-shaped notch. Upon cooperative coupling and fastening of a correspondingly shaped bracket 132 (i.e. having outwardly angled U-shaped edge 133) within this notch, adjacent end support structures 112, 112' are progressively brought together to provide tight abutment of adjacent housings 104 and 104'. As will be described in greater detail below, end-to-end coupling and installation of different curved and/or straight luminaire modules 102 may lead to the formation of different rectilinear and/or curvilinear luminaire patterns, which may ultimately include but are not limited to, closed-loop patterns, such as the circle luminaire of FIG. 7G; curvilinear and/or sinuous patterns, such as the S-shaped luminaire of FIG. 8A; and crisscrossed patterns, such as the X-shaped luminaire of FIG. 9, to name a few.

Figure 3A:
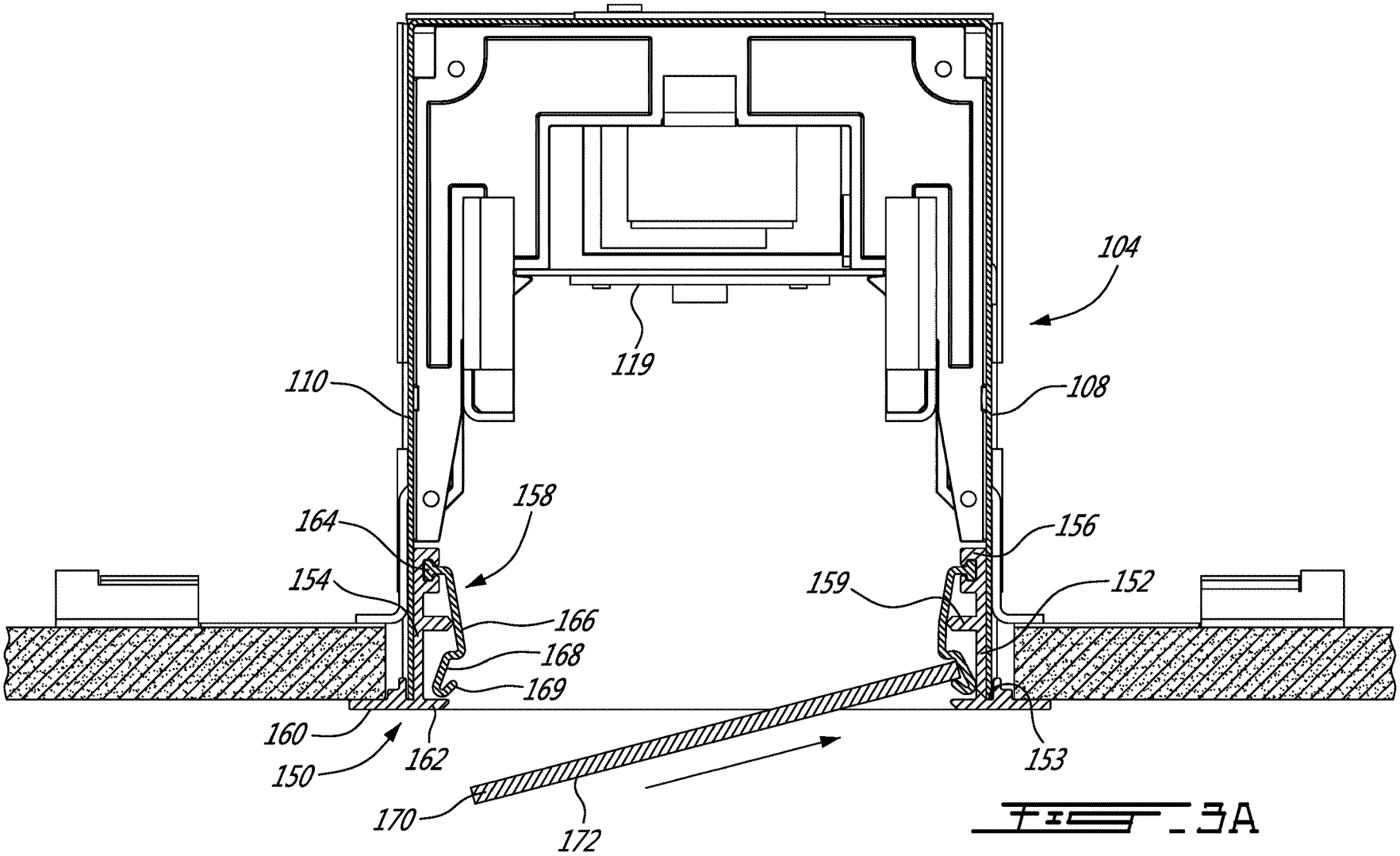
FIGS. 3A and 3B are sequential cross-sectional views of the luminaire module of FIG. 1A, showing operation of an output element coupling mechanism thereof for installation of an output element therein, in accordance with one embodiment of the invention.
Figure 3B:
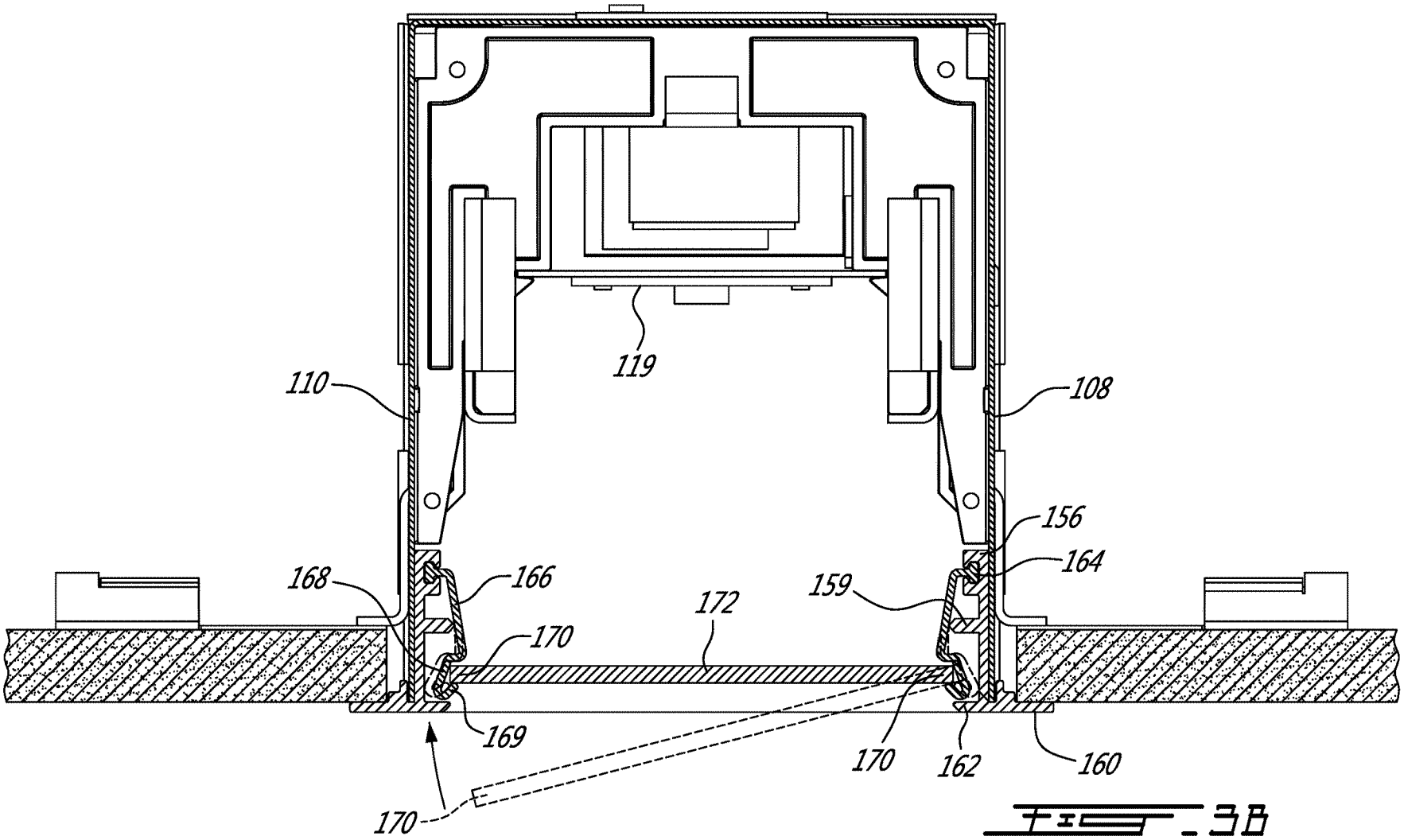

With particular reference now to FIGS. 1A, 3A and 3B, an output assembly, generally referred to using the numeral 150, will now be described. Output assembly 150 is generally provided for cooperative engagement or assembly with the housing 104 in positioning one or more output elements in the illumination path of the luminaire's light source(s), in this embodiment consisting of LED boards 119. In this embodiment, the output assembly comprises opposed arcuate liners 152 each having a generally T-shaped cross-section. An external notch 153 formed at the intersection of the T-shaped liners 152 is shaped and sized to receive pressure fitted therein, an upper extremity of the housing walls 108, 110. Respective vertical bands 154 of the liners 152, which extend internally along the housing walls 108, 110, are then mechanically coupled to the housing walls via appropriate fasteners, such as rivets (not shown). The vertical bands 154 further define, at a lower extremity thereof, a generally C-shaped coupling rail 156 disposed so to receive therein, in sliding engagement, operative coupling of a lower extremity of a resilient output coupling flange 158. An inward projection 159 is also provided to enhance and maintain a resilience of the coupling flange 158, which may prove particularly beneficial in the context of a curved module of smaller turning radius (e.g. 3 foot diameter vs. 8 foot diameter) as the output coupling flange 158 may be inclined to angle outwardly along the bend and thus reduce its efficiency.

A horizontal component of each liner 152 generally defines an outer flange 160, generally disposed, in one embodiment and as will be discussed in greater detail below, for the concealment of a gap formed during recessed installation of the luminaire 102, and an inner flange 162, providing for partial concealment of the output coupling flange 158, discussed below. In one embodiment, the liners 152 are manufactured of extruded, and in the context of an arcuate embodiment, rolled aluminum, though other manufacturing materials and techniques may readily apply, such as metal and/or plastic molding, casting and the like, as will be appreciated by the skilled artisan.

The output coupling flange 158 generally consists of a resilient hook-like band structure having a generally T-shaped coupling bead 164 at a lower extremity thereof that is shaped and sized to slidingly engage correspondingly shaped and sized coupling rail 156. An intermediate band 166 of the coupling flange 158 extends from the coupling bead 164 and terminates in a hook-like coupling structure 168 having a beveled upper hook portion 169 and being configured to mechanically receive and retain therein edges 170 of the output element 172.

A material and shape of the coupling flange 158 is selected so to provide an inward lateral bias of the coupling structures 168 toward the edges 170 of the output element 172. Upon one of these edges 170 applying an inward force against one of the beveled portions 169, an outward lateral displacement of the associated coupling flange 158 is induced as the edge 170 passes beyond the beveled portion 169 and comes to rest within the hook-like structure 168. At that point, the natural bias of the coupling flange 158 springs or snaps the upper hook portion 169 back over the edge 170 of the output element 172 to secure it into place. In one installation method, illustrated sequentially in FIGS. 3A and 3B, a first output element edge 170 is inserted within a corresponding coupling structure 168, which insertion may act to retract this coupling structure 168 under inner flange 162. A second edge 170 of the output element 172 may then be pressed against the beveled portion 169 of the opposed coupling structure 168, thereby effectively retracting at least one, if not both of the coupling structures 168 to allow passage of the second edge beyond the corresponding beveled portion 169 and effectively snap into place. Other techniques may also be employed, as will be readily appreciated by the skilled artisan, to benefit from the resilience of the opposed coupling flanges 158, such as a direct bilateral push-in action on the output element 172 and other such techniques, depending on the materials, dimension and shape of the output element 172, for example, and other such considerations.

Figures 5, 6:
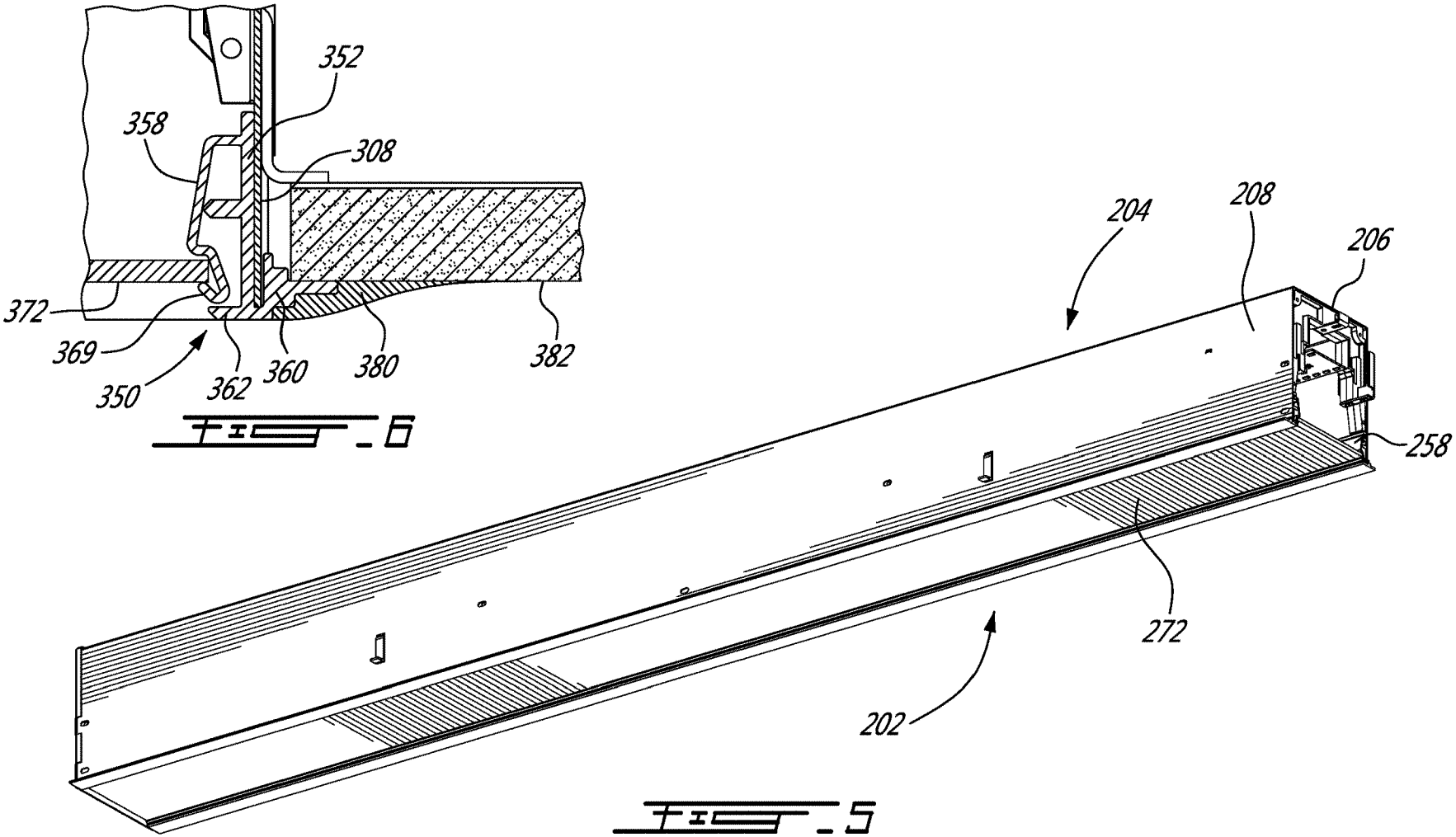
FIG. 5 is a perspective view of a straight luminaire module, in accordance with another embodiment of the invention.
FIG. 6 is a partial cross sectional view of a luminaire module showing a detail of an output assembly and recessed installation thereof, in accordance with another embodiment of the invention.

With reference now to FIG. 5, and in accordance with another embodiment, a straight luminaire module 202 is again adapted for end-to-end mounting adjacent similar luminaire modules, be they also linear, or curved as in FIG. 1A, in the formation of an assembled luminaire output pattern. The module 202 generally comprises a housing 204 having a base 206 and opposed side walls 208, such as described above, for example, to house one or more lighting elements along with various lighting element driving, powering and supporting components appropriate therefor. The module 202 further comprises an output assembly similar to assembly 150 of FIG. 1A, namely providing opposed inwardly biased coupling flanges 258 to resiliently receive and retain opposed edges of an output element 272 therein.

With reference to FIG. 6, and in accordance with another embodiment, an output assembly 350 combines the structures of the liner 152 and output coupling flange 158 described above with reference to FIGS. 1 to 3, in the formation of a unitary output coupling component 352. The provision of unitary output coupling components 352 may, for example, allow for a more rapid assembly and/or installation by reducing the number of assembled parts and components, at the expense, however, of reducing the number of selectable materials for each component in the process. For example, where some embodiments may benefit from an extruded and rolled aluminum liner having a plastic coupling flange slidingly engaged therein, as described above, other embodiments may rather benefit from the provision of a unitary output coupling unit, as shown in FIG. 6, manufactured of a singular material and process (e.g. a single extrusion).

Figure 10:
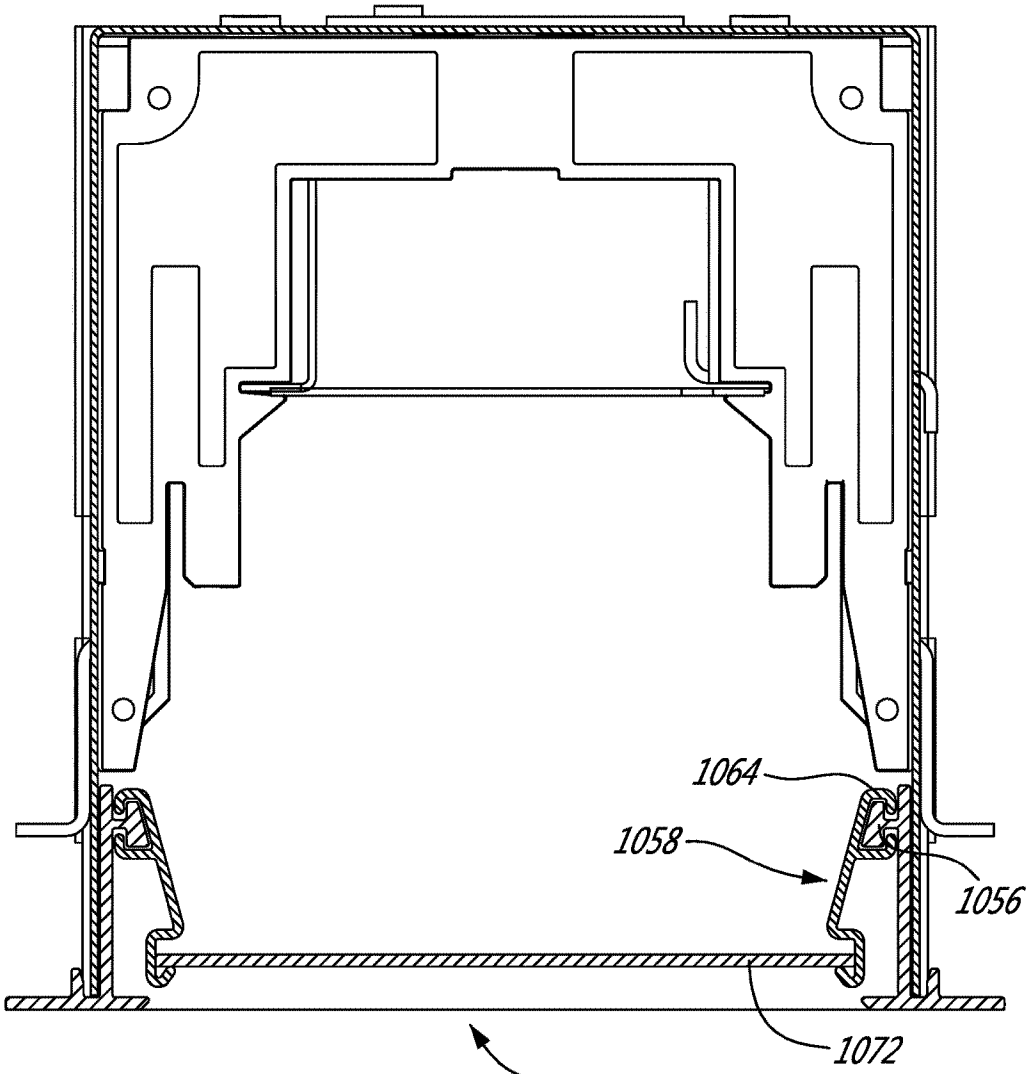
FIG. 10 is a cross-sectional view of a luminaire module, showing an alternative output element coupling mechanism thereof for installation of an output element therein, in accordance with another embodiment of the invention.

With reference to FIG. 10, and in accordance with another embodiment, an alternative output assembly 1050 provides for an alternative coupling between output flange 1058 and coupling rail 1056, with the remaining features and structures of the output assembly 1050 remaining substantially the same as for output assembly 150 of FIGS. 1 to 4 described above. In this arrangement, the coupling rail 1056 is generally T-shaped as opposed to C-shaped as discussed above with reference to coupling rail 156, and the coupling flange 1058 provides a correspondingly C-shaped coupling structure 1064 that slidingly engages the T-shaped coupling rail 1056. To further accentuate the angular orientation and bias of the coupling flange 1058 so to promote a greater and more reliable inward retention force on the output element 1072, the T-shaped coupling rail 1056 is shaped so to define an asymmetric cross-section beveled to inwardly bias the coupling flange 1058 upon engagement therewith. Using this design, the function of the inward projection 159 discussed above with reference to FIGS. 3A and 3B may be integrated within the design and shape of the asymmetric coupling rail 1056 and correspondingly shaped coupling structure 1064.

In other embodiments (not shown), the liners 152 of FIG. 1A, or part thereof, may rather be integrated within respective housing side walls, for example whereby a coupling rail, such as rail 156 of FIG. 1A, may be integrally formed within each housing wall to receive in sliding engagement therewith a correspondingly shaped output flange coupling structure. Similarly, outer and inner flanges, such as flanges 160 and 162 shown in FIG. 1A, respectively, may be formed integrally with the casing side walls, or again form part of a distinct component altogether.

In that respect, it will be appreciated that while outer and inner flanges may be desirable in some embodiments, other embodiments may rather dispense of such flanges altogether, or again, select to include only an inner or outer flange depending on the intended aesthetic outcome of the product and application at hand. Furthermore, differently shaped and sized flanges may be considered as can flanges providing for alternative functionality, such as for example, the step-wise outer flange 360 of FIG. 6. For instance, the provision of flange 360 may allow for smoother integration of a recessed luminaire within a surface material by providing a textured surface amenable to a "mud-in" finish. For example, where the luminaire is installed recessed within a drywall surface, drywall mud 380 (shown exaggerated for illustrative purposes in FIG. 6) may be laid over the textured outer flange 360 to provide a continuous transition to the drywall surface 382. These and other such alternatives should now be readily apparent to the skilled artisan, and are therefore intended to fall within the general scope and nature of the present disclosure.

The provision of opposed inwardly biased coupling structures, as described above, provides a resilient output element coupling mechanism which not only secures the output element against vertical displacement post-installation (i.e. keeps the output element from falling out), but also provides a degree of retention against sliding displacement of the output element along the length of the luminaire module and/or luminaire as a whole, a feature particularly relevant in the provision of a vertically or angularly oriented luminaire where gravity acts, at least in part, along the length of the luminaire.

Furthermore, the provision of a snap-in output element, as described above, allows for a reduction of the lateral spacing required beyond an overall width of the output element to manage installation thereof without bending or warping the output element, housing walls and/or risking the output element inadvertently falling out post installation. For example, other methods of installation may include laterally bending or warping the output element so to sequentially secure each lateral edge thereof (e.g. to otherwise secure opposed edges 170 below inner horizontal flanges 162 in FIG. 3B). A clear disadvantage to this method is the need to bend or warp the output element, which may not be desirable or even possible depending on the output element material properties, size and/or shape. For instance, it may become particularly difficult to handle for particularly large and/or rigid output elements.

In another alternative installation method, commonly known as a "lift and shift" method, a first edge may be entered below a first flange and shifted sufficiently to allow for the opposed edge to bypass an opposed flange, the output element then being laterally shifted to secure both edges below respective flanges. Using this method, the output element may risk being dislodged and falling out, or again sliding along the length of the luminaire. A further disadvantage rests in the fact that wider inner flanges are generally required to provide sufficient spacing to allow for the output element to shift laterally to accommodate a full width of the output element between flange edges. Further, certain shapes and configurations simply do not lend themselves to this method, for instance, curved and S-shaped output elements would be difficult, if not impossible to wield through such installation, whereas closed-loop or other shaped output elements would outright be impossible to install, even when attempting to significantly warp the element.

On the other hand, given the snap-in action of the inwardly biased coupling flanges described above, a much narrower tolerance can be appreciated on the dimension of the opposed inner flanges 162. For example, in one embodiment, a tolerance of no more than ½ inch, or even of no more than ¼ inch, may be sufficient to enable snap-in installation of a given output element, and that, irrespective of the shape, size and orientation of the luminaire. This tolerance is compared to a tolerance of more than 1 inch to apply the "lift and shift" installation technique, and that, limited to substantially rectilinear luminaires. Accordingly, the provision of the above-described snap-in mechanism allows not only for a versatile installation method, but also permits for the manufacture of a tighter construction, which, in the context of a recessed luminaire installation, as will be described in greater detail below, may allow for a sleeker finished look. For instance, within the context of a mud-in recessed luminaire embodiment (e.g. see FIG. 6), wherein a finished installation is effectively blind to the provision of an outer flange, a tight lateral tolerance on output element coupling dimensions may lead to a particularly convincing integration of the luminaire within the surface material. For example, in the embodiment of FIG. 6, an output element 372 is framed only by a segment of the beveled hook portion 369, and a visible portion of the inner flange 362 concealing a nominal gap between the coupling flange 358 and housing wall 308.

Furthermore, and as noted above, using the snap-in approach enabled by the above-described construction, different shapes and sizes of output elements may be snapped into place, in different embodiments, with minimal effort and with practically no warping or bending. For instance, a seamless ring-shaped, S-shaped and X-shaped output element, as shown in FIGS. 7G, 8A and 9, respectively, may be uniformly or progressively snapped into place using the above construction, a feature not readily achievable using currently known techniques.

In one embodiment, the output element consists of a substantially flat component, as shown for example in the appended Figures, wherein such a component may be readily provided in various shapes and sizes without the need for complex machinery. Namely, a flat output lens, filter or window may be cut or punched from sheet materials having the desired properties, such as glass, plastics, Plexiglas, and the like. For example, a flat output lens may consist of a clear plastic sheet cut to the right shape and size, or again provide for a diffusive or filtering (e.g. colouring) effect. More complex materials may rather include various material patterns and/or designs for guiding, directing or even partially blocking output light to achieve a particular effect. Similarly, various masks may be cut to size and used, instead of or in combination with an output lens to provide a desired effect, as can other components as will be readily appreciated by the skilled artisan. Namely, given the versatility of the above-described coupling mechanism, different sheet materials may be cut to the appropriate shape and coupled to the output assembly irrespective of material flexibility as the required spacing and flexibility for installation is inherently absorbed, at least in part, by the resilient coupling flanges. Similarly, a particularly rigid output element may still be installed between and along particularly rigid housing walls, for instance within the context of a recessed installation where side walls may be snugly recessed within the receiving surface material.

With reference now to FIGS. 7A to 7G, an installation method will now be described for a series of curved luminaire modules, such as module 102 of FIGS. 1 to 3, in the formation of a recessed ring-shaped luminaire, generally referred to using the numeral 700. Details of related installation methods can also be found in Applicants co-pending Canadian Patent Application No. 2,815,622 filed May 10, 2013. In this particular embodiment, an alignment module 702 is provided for each luminaire module 752 in outlining an installation pattern for the ring-shaped luminaire 700. For instance, each template or alignment module 702 may be mounted to a surface support structure, in this example consisting of a false ceiling grid 708 suspended from a structural ceiling 710 via support rods 712 or the like, to which a surface material 750 (e.g. see FIG. 7C) may be subsequently installed to provide a finished appearance. As will be described in greater detail below, the inner edges 714 of the aligned modules 702, once mounted, define a substantially continuous spacing 716 that reflects the designated pattern of the luminaire 700 to be installed recessed within the surface material 750. These inner edges 714 may thus provide guidance in the subsequent removal of surface material from within this spacing 716 (e.g. see FIG. 7D) to define an aperture within the surface material 750 consistent with the luminaire 700 to be installed recessed therein.

In this example, each template module 702, in this example a series of curved modules, generally comprises opposed longitudinal edges 714 distanced relative to one another so to define a lateral spacing 716 therebetween, generally selected to at least accommodate a width of the corresponding luminaire module 752 to be installed. In this example, the opposed edges 714 are defined by the opposed inner edges of laterally spaced planar members, a planarity of which serving to facilitate installation of the template modules 702 against the surface material 750. A series of linear fastening slots are also provided through the planar members to facilitate mounting of the module 702 to an appropriate support structure, such as false ceiling structure 708.

In this embodiment, one or more removable crosslinks or like structures 720 are also provided to define and maintain a set spacing between edges 714 during installation, which crosslinks 720 may then be removed to provide for unobstructed guided surface material removal along the inner edges 714.

Figure 4:
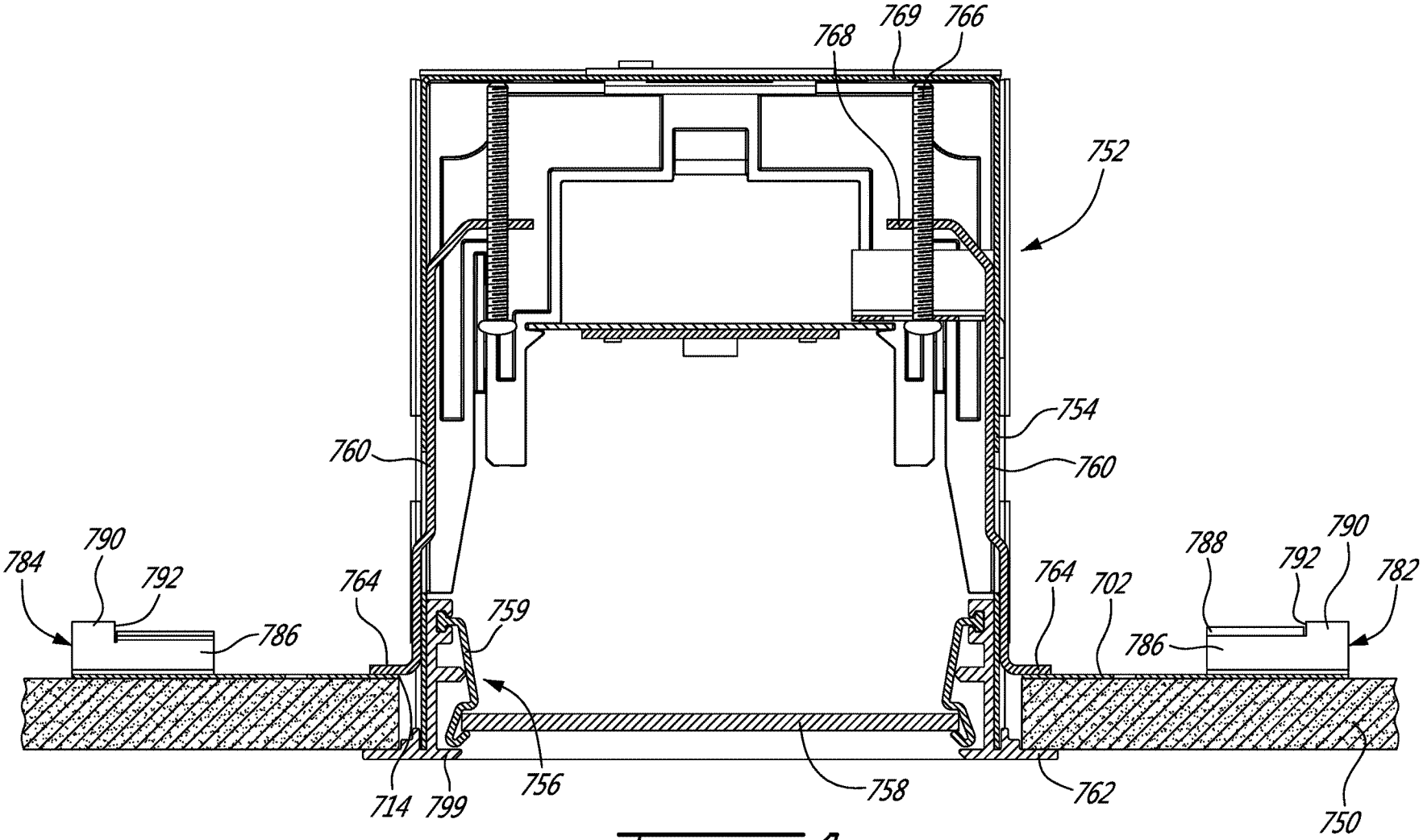
FIG. 4 is a cross-sectional view of a luminaire module, showing a flush mounting mechanism provided therewith in securing a flush recessed installation of the luminaire module against a material surface.

With added reference to FIG. 4, each template module 702 further comprises a pair of alignment structures 782, 784 respectively defined at each longitudinal extremity thereof, namely at each corner, for alignment and cooperative engagement with corresponding alignment structures 784, 782, respectively, of an adjacently disposed template module. In this example, each alignment structure comprises a longitudinal alignment feature, such as vertical tab 786, for guiding end-to-end abutment of adjacent modules. Each alignment structure further comprises a lateral alignment feature, in this example extending from vertical tab 786 and defined by a bent horizontal foot 788 split from a vertical tab extension 790 so to cooperatively engage, in the context of alignment structure 782, a lateral edge 792 of an adjacently disposed alignment structure 784, and in the context of alignment structure 784, so to allow for cooperative engagement of an adjacent horizontal foot 788 of and adjacently disposed alignment structure 782 against lateral edge 792. Accordingly, respective inner edges 714 of adjacent template modules 702 may be effectively aligned in forming a substantially continuous spacing 716, particularly upon subsequent removal of crosslinks 720.

Figure 7A:
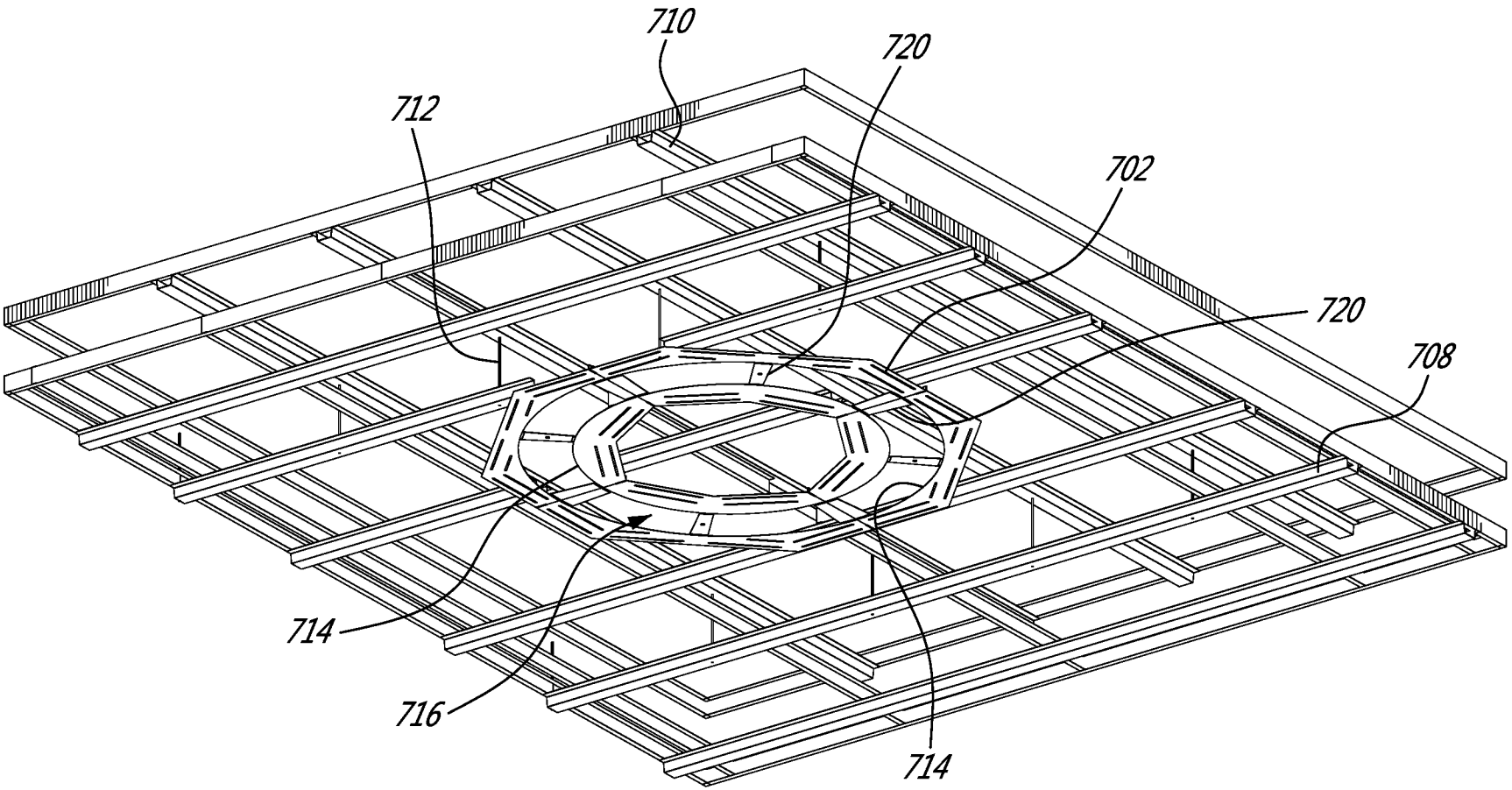

As introduced above, and as best seen in FIG. 7A, the template modules 702 are first adjacently mounted end-to-end to false ceiling grid 708. To accommodate the downstream recessed installation of the luminaire 700, elements of the false ceiling grid 708 that would otherwise interfere with the recessed installation are removed, and/or omitted. Ultimately, the assembly of the four (4) arcuate modules 702 results in the formation of a ring-like pattern having, in this particular example, a 3 foot diameter.

Figure 7B:
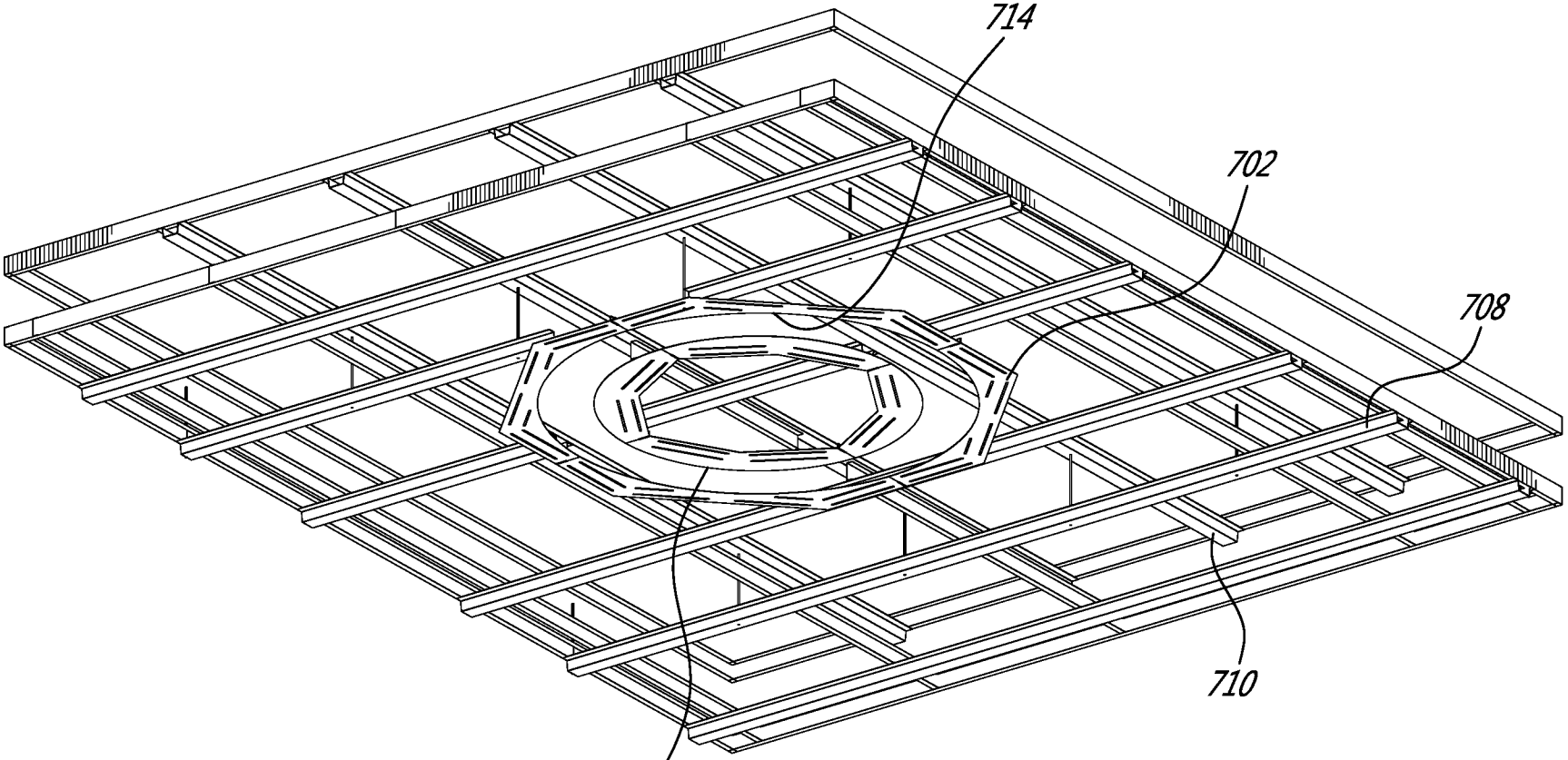

With particular reference to FIGS. 7A and 7B, once the modules 702 are adequately aligned and mounted, the inner edges 714 thereof define, in combination, a substantially continuous spacing 716 that reflects the designated pattern of the luminaire to be installed. The crosslinks 720 may then be removed (e.g. snipped, cut and/or broken off) such that inner edges 714 may provide a substantially unobstructed guide (e.g. see FIG. 4B) for the subsequent removal of surface material within the continuous spacing 716 so defined.

Figure 7C:
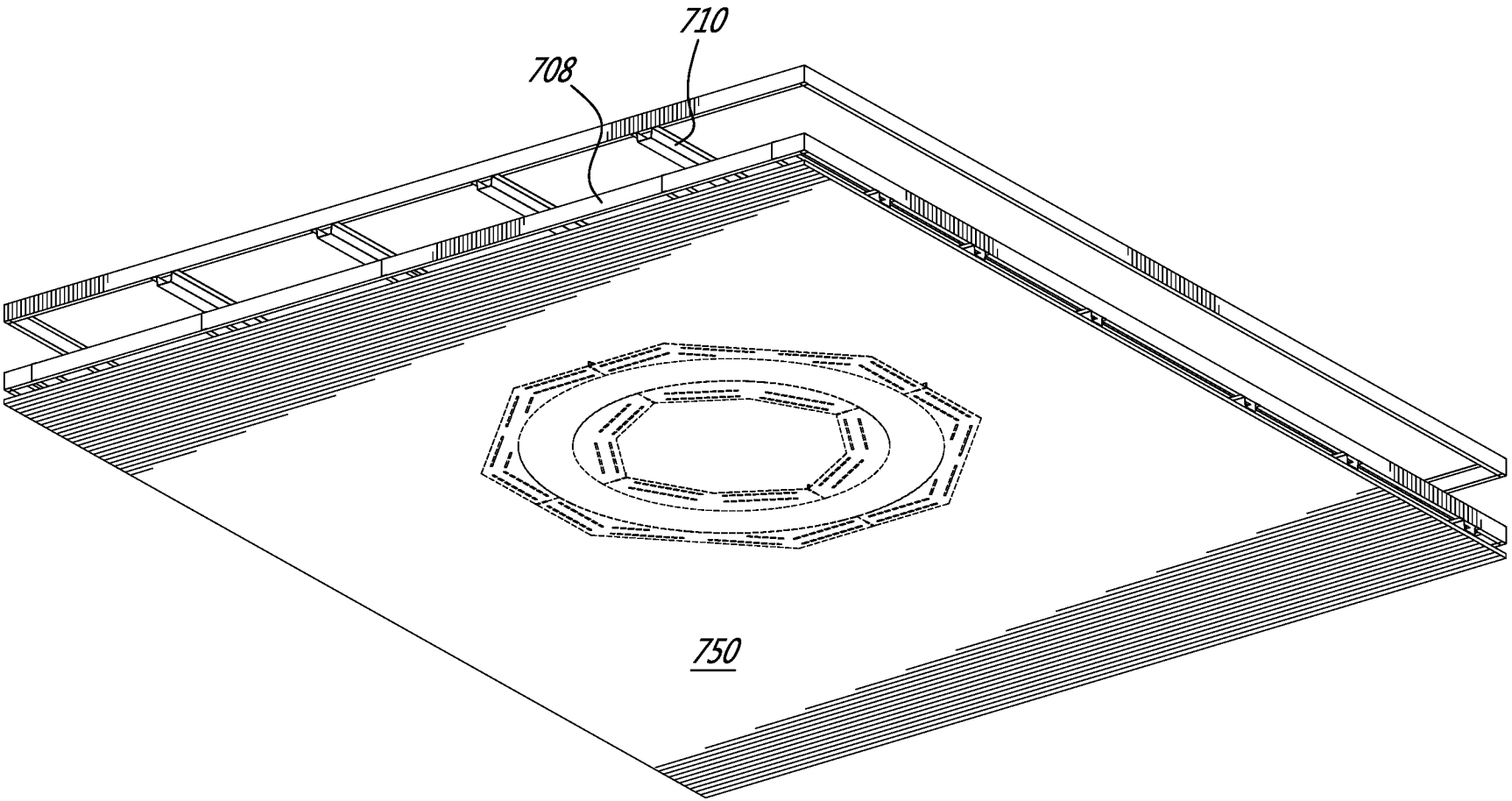
Figure 7D:
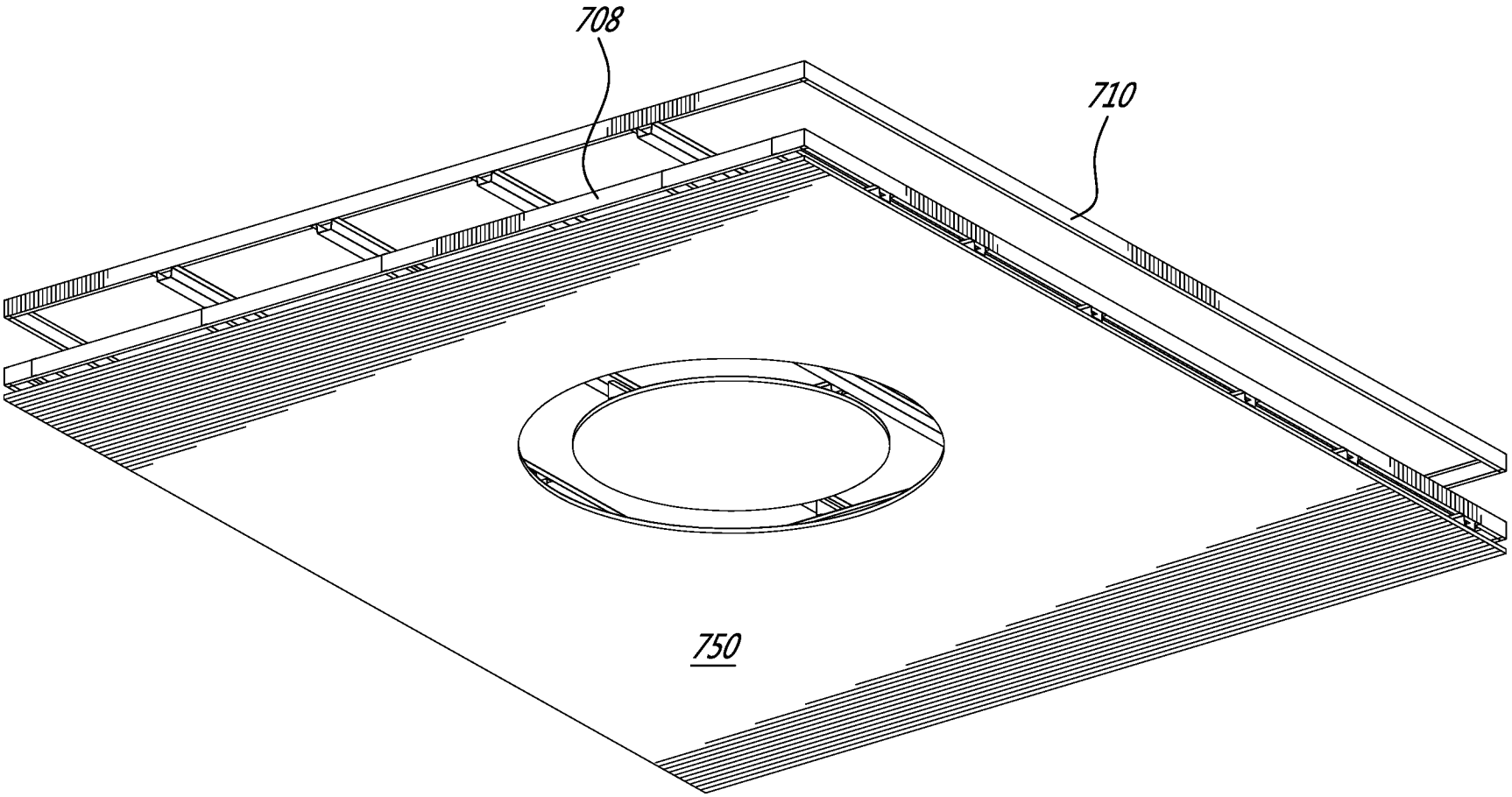

As shown in FIG. 7C, a selected surface material 750 may then be installed over and against the mounted modules 702, keeping track of a general location of the installed modules 702 for subsequent steps. Using an appropriate tool, such as a saw, knife, router or other such rotary tool, or other tool appropriate for the surface material at hand, the aligned inner edges 714 may be used as a guide in removing surface material from the spacing 716, resulting in a surface aperture consistent with the designated luminaire pattern (e.g. see ring-shaped aperture of FIG. 7D).

Figure 7E:
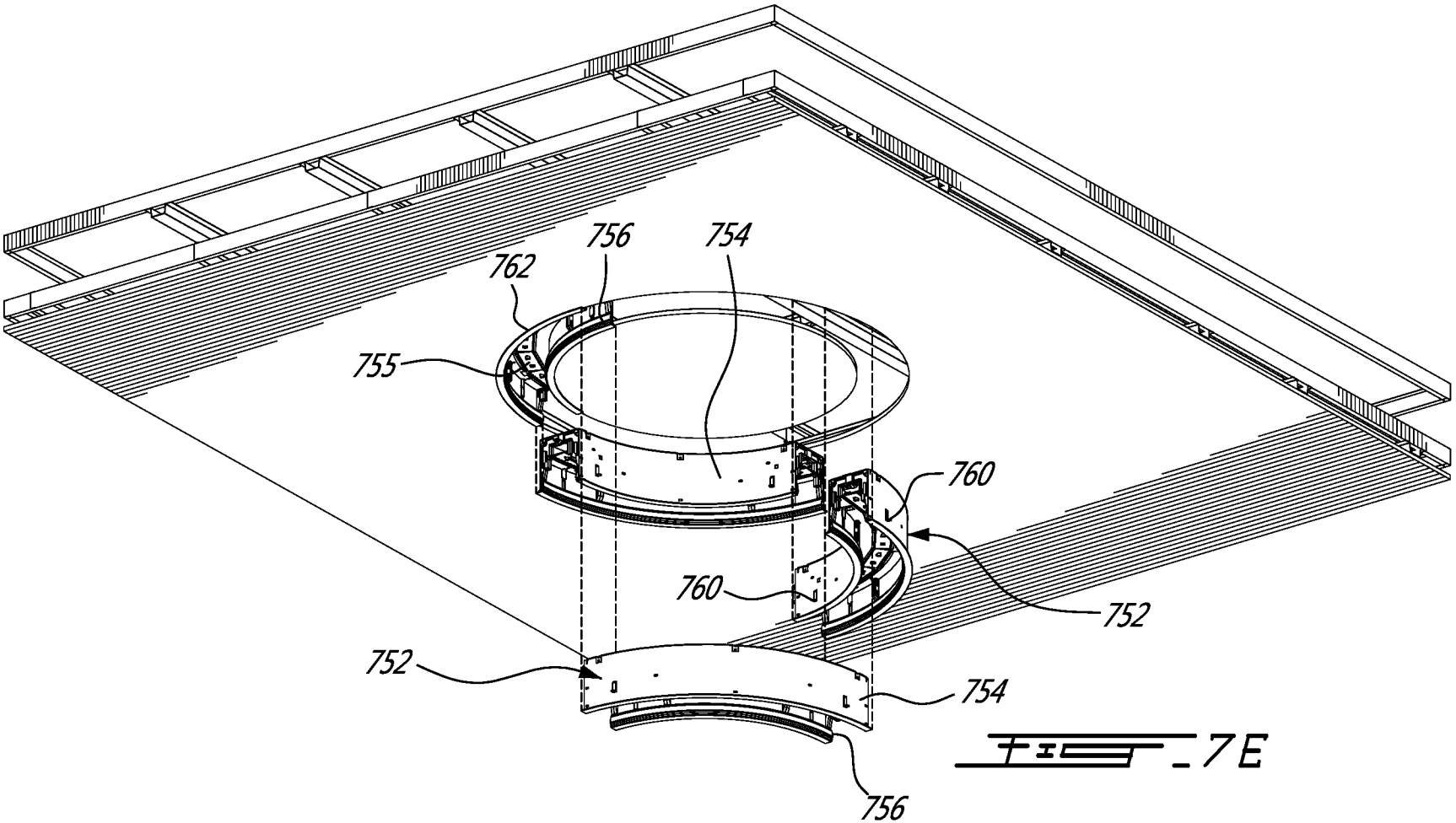
Figure 7F:
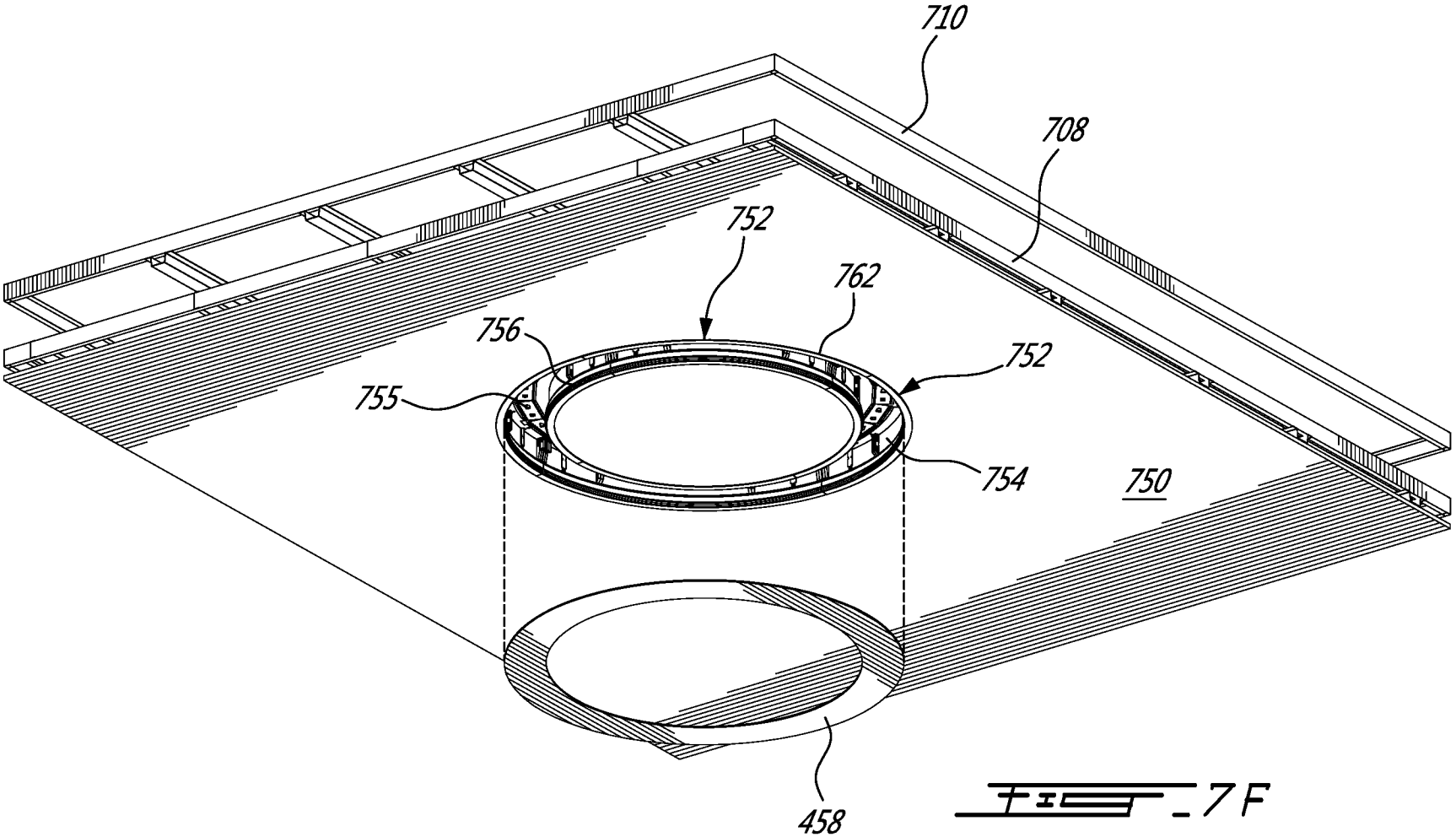
Figure 7G:
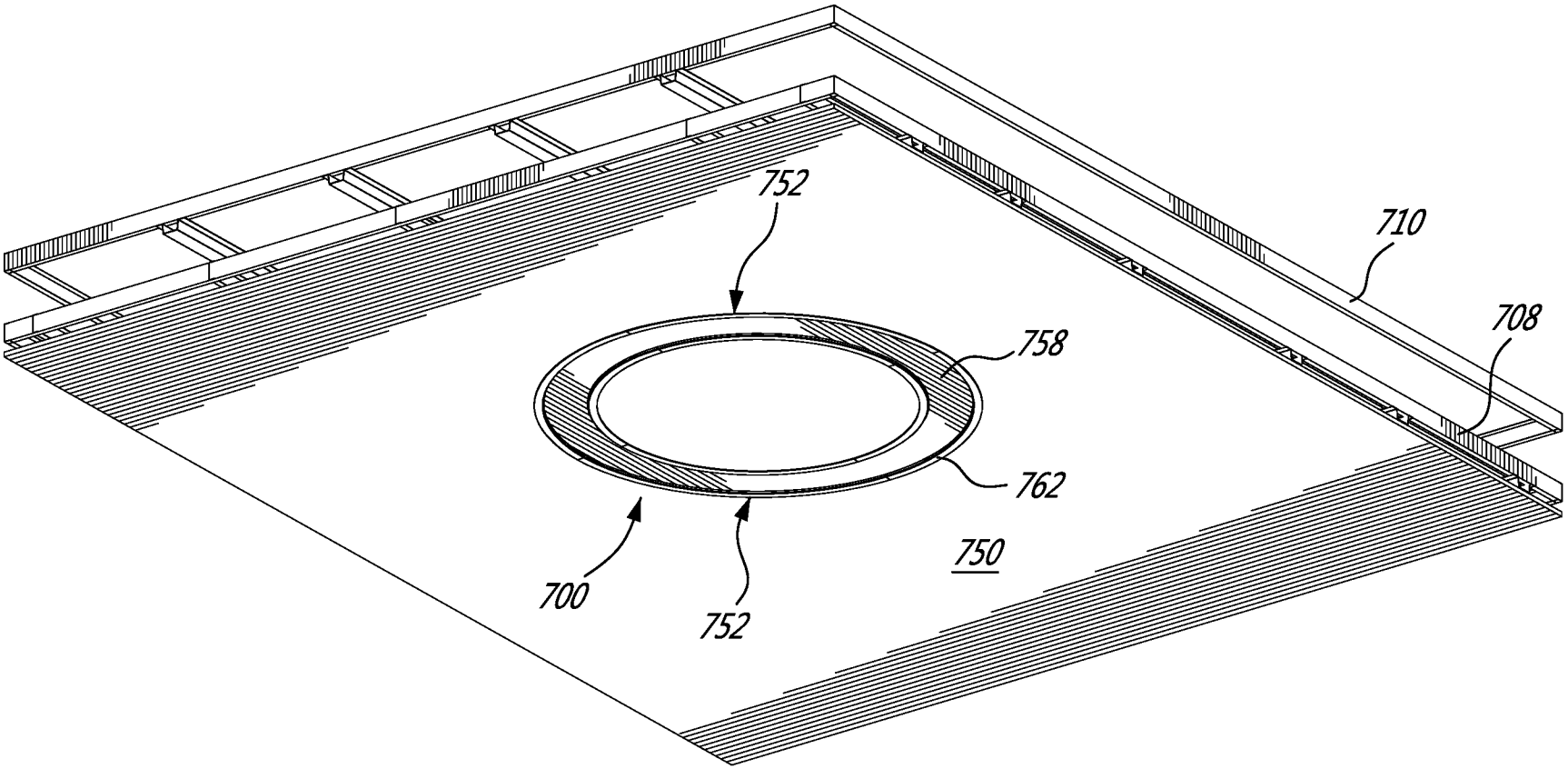

With reference to FIGS. 7E to 7G, and in accordance with one embodiment, the luminaire 750 consists of an assembly of four (4) curvilinear luminaire modules 752, each one of which comprising an arcuate housing 754 (e.g. housing various lighting components such as LED boards 755, and associated driving means) to be assembled end-to-end in forming the designated pattern. For instance, each housing 754 may be installed in sequence, for example via appropriate fastening means (e.g. bolts, screws, cables and the like—not shown) rigidly coupling a base of the housing to the structural ceiling 710, and interconnected to each subsequent housing via appropriate end-to-end coupling means (e.g. using end brackets 130 and 132 described above with reference to FIGS. 1 to 3). Alternatively, each housing 754 may be preassembled in the designated configuration and installed as an assembled unit. These and other such considerations will be readily appreciated by the skilled artisan, and are therefore intended to fall within the general scope and nature of the present disclosure.

In this embodiment, and with added reference to FIG. 4, each housing 754 is further provided with one or more pairs of adjustment brackets 760 which, upon adjustment, displaces its outwardly projecting foot 764 to press against the edge of its corresponding template module (i.e. on the hidden side of the surface material 750) and thus squeeze the juxtaposed edges of the surface material and template module at the aperture between the foot 764 of the adjustment bracket 760 and an outer flange 762 of the luminaire module 752. For example, adjustment bracket 760 may consist of an elongated S-shaped bracket, which is first pivoted inwardly to retract bracket foot 764 within the housing 754 and thus allow passage of the housing 754 and retracted foot 764 through the aperture defined within the surface material. The bracket may then be pivoted in the opposite direction to redeploy the foot 764 to rest on the edge of the template module 702 disposed against the reverse side of the surface material 750. A fastener, such flat tip screw 766, may be fastened through an opposed inwardly projecting foot 768 so to abut against the base 769 of the housing 754 and ultimately act, when tightened, to lower (in this configuration) the outward foot 764 against the template module 702 and surface material 750, and thus act to raise the luminaire module's output flange 762 flush against the visible surface of material 750.

Accordingly, the template modules 702 may not only act as an alignment tool and guide for the outlining of the luminaire installation, but may also provide reinforcement at the edge of the surface material aperture in securing a flush installation of the luminaire's outer flange 762, ultimately promoting a more refined finish.

Each luminaire module 752 further comprises an output lens coupling mechanism 756 (as described above and shown again in FIG. 4) along its periphery for the subsequent installation of an output lens, in this example consisting of a seamless ring-shaped flat lens 758 that snaps into place along its inner and outer edges. In one example, the output lens coupling mechanism 756 consists of opposed resiliently biased coupling flanges 759 shaped and configured to expand upon the lens being pushed against it, and spring back into position to hook and thus retain the edges of the lens 758 in position. Other lenses or output element configurations (e.g. partitioned lens, filter, mask, diffuser, etc.) may also be considered, as will be readily appreciated by the skilled artisan, As seen from this example, the assembly of template modules may include a corresponding alignment module 702 for each of the luminaire modules 752, thereby allowing for outlining of the combined pattern prior to installation of the luminaire 700. Using this approach, and considering different combinations of template module shapes, sizes and/or configurations (e.g. rectilinear modules and/or curved modules, possibly of different turning radii), different examples of luminaire patterns may include, but are not limited to, closed loop patterns such as circles, ovals and the like; rectilinear patterns such as square or rectangular boxes, X-shaped patterns, etc.; curvilinear patterns such as sinusoids, curls, spirals, squiggle lines and the like; and various combinations thereof, to name a few.

In the illustrated embodiment of FIGS. 7A to 7G, each module is mountable to a surface support structure prior to installation of the surface material. A similar embodiment may rather have the modules mounted directly to the surface material, for example via appropriate fasteners and/or adhesives, to be removed thereafter (or left there as an aesthetic complement to the luminaire).

As will be appreciated by the skilled artisan, template or alignment modules such as those described above may be manufactured of different materials, which may include, but are not limited to, rigid plastics, polymers or other such composites, or again of different sheet metals such as steel or aluminum, to name a few. Modules may be stamped or otherwise formed depending on the material selection, and cut or punched to size and/or to exhibit the various features described above. Furthermore, while the above contemplates the provision of substantially flat modules, other shapes and sizes may be readily applied depending on the intended application. For example, where the apparatus is to be installed between a surface material support structure and the surface material itself, then it may be advantageous to have the templates formed of a substantially flat material. On the other hand, where the modules are to be aligned and installed above the surface material, while the provision of a flat contact surface may be desirable, the general thickness profile of the modules may take different forms, for instance in facilitating manipulation in manual installation, for example. These and other such considerations will be readily apparent to the person of ordinary skill in the art, and are therefore intended to fall within the general scope and nature of the present disclosure.

Furthermore, while the above describes a recessed ceiling installation, similar installations may also be considered in a wall or floor surface, or again along other surface geometries, such as in room partitions, furniture, exterior accent or ambient lighting structures, interior lighting accent architectures and the like. Accordingly, while terms such as up/down, vertical, horizontal and the like apply in the selected orientation of the illustrated embodiments, it will be appreciated that reorientation of these embodiments and their equivalents may entail a realignment of general descriptive directional terms used herein, without departing from the intended scope of the present disclosure. Namely, directional terms are used herein solely for the purpose of illustrating one particular embodiment, and should not be construed as limiting within the general context of this disclosure as a whole.

The apparatus and method described herein may also be applicable for the outlining and recessed installation of a luminaire within different surface materials. Examples of materials may include, but are not limited to, drywall, plasterboard, gypsum board and/or other such materials, as can other materials apply such as plywood, particle board, sheet metal and/or plastics, and the like, to name a few. Namely, while the selection of tools for the subsequent guided removal of material from the continuous gap defined by the aligned modules may vary depending on the material at hand, as can the selection of material for the modules itself change depending on the strength/durability required thereof in guiding such tool selection, similar principles may nevertheless be applied in outlining a recessed installation within a variety of material surfaces, and that, all within the general context of the present disclosure.

As described above and illustrated in FIG. 7G, an assembled luminaire 700 of luminaire modules as described above may ultimately take the form of a closed loop circle recessed within a surface material. Namely, a series of curved modules 752 are aligned and mounted end-to-end and recessed within the surface material to take the illustrated shape. As shown in FIG. 4, each module 752 generally comprises a recessed housing 754 and an output assembly 756, wherein outer flange 762 provides for concealment of a gap formed between each housing 754 and the surface material 750, and wherein an inner flange 799 provides partial concealment of coupling flange 759. As shown, a singular seamless ring-shaped output lens 758 can then be raised and snapped into place. Using a "lift and shift" installation method, multiple shorter output lenses would have been required to trace a similar pattern, as would a wider width tolerance needed through thicker inner flanges to accommodate this installation method, both of which requirements would necessarily increase installation labor requirements, reduce an integrity of the installation, and reduce an overall aesthetic appeal of the luminaire design.

Figure 8B:
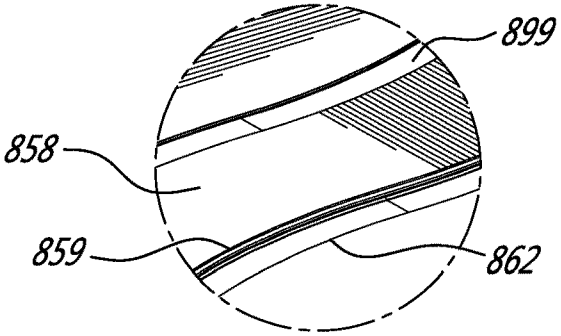
FIG. 8B is an enlarged view of the luminaire of FIG. 8A taken along line 8B-8B thereof, showing an externally visible profile of an output assembly thereof, in accordance with one embodiment of the invention.
Figure 8A:
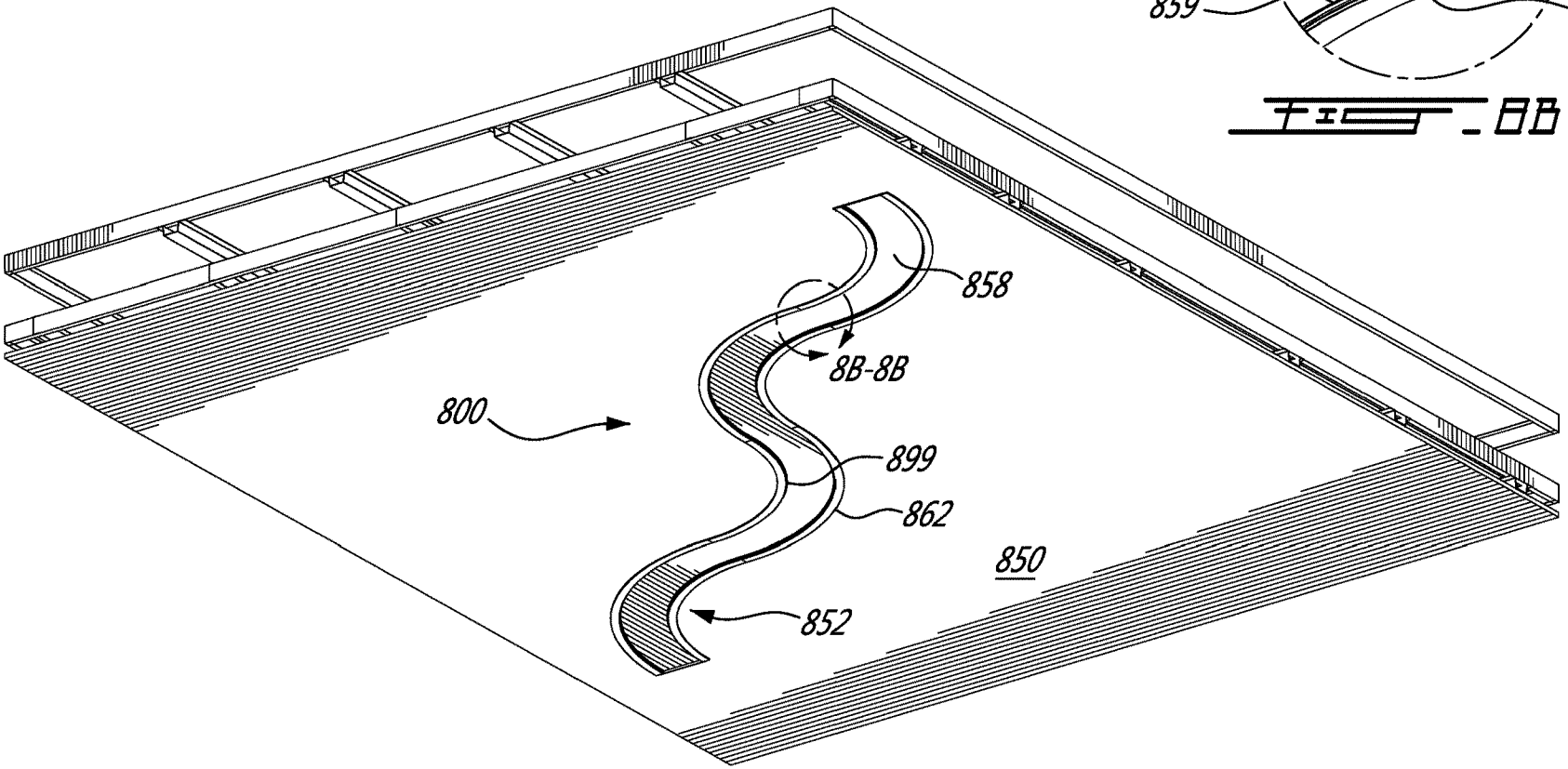
FIG. 8A is a perspective view of a sinuous luminaire installed recessed within a surface material, and having a seamless output element and seamless output element coupling flanges, in accordance with one embodiment of the invention.
Figure 9:
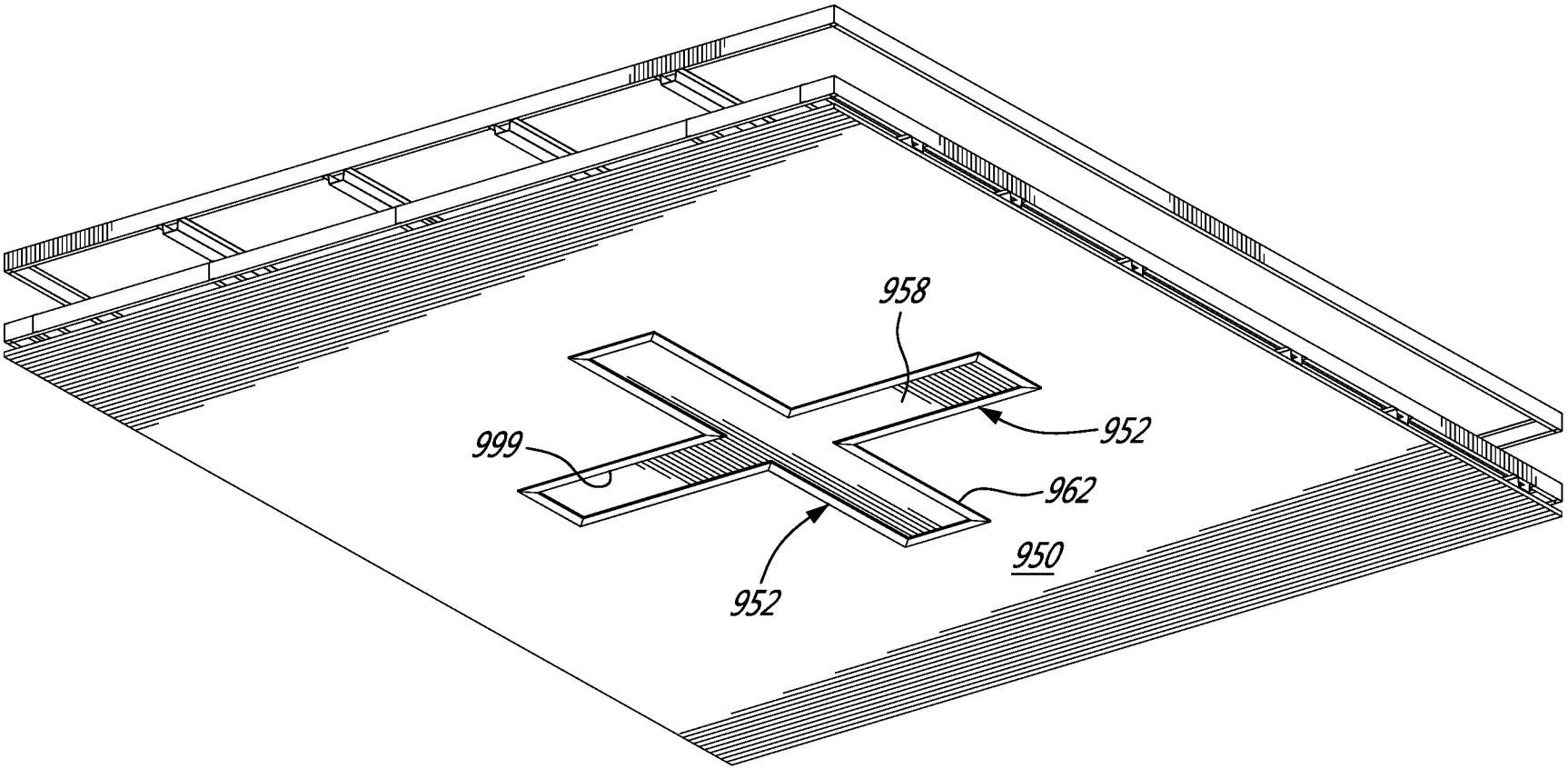
FIG. 9 is a perspective view of an X-shaped luminaire installed recessed within a surface material, in accordance with one embodiment of the invention.

With reference now to FIG. 8A, and in accordance with one embodiment, an assembled luminaire 800 is shown to take the form of an S-shaped pattern recessed within a surface material 850, such as a false drywall ceiling or the like. Namely, a series of curved modules 852 are aligned and mounted end-to-end and recessed within the surface material 850 to take the illustrated shape. As in the example above, each module generally comprises a recessed housing (not shown) and an output assembly, such as output assembly 150 described above with reference to FIG. 1A, wherein outer flange 862 provides for concealment of a gap formed between each housing 854 and the surface material 850, and wherein an inner flange 899 (shown as contiguous to outer flange 862) provides partial concealment of coupling flange 859. A singular seamless S-shaped output lens 858 can be snapped into place, benefiting from similar advantages as described above with respect to other embodiments. In this example, singular, seamless coupling flanges 859 are also provided along the entire length of the luminaire 800 (as best seen in FIG. 8B), thereby further reducing visible breaks in the luminaire assembly. For example, in one such embodiment, the various luminaire housings may be pre-assembled to receive a continuous coupling flange 859 slidingly coupled along either side wall thereof, before the assembled housings are then mounted recessed within the surface material and the output lens 858 snapped into place.

In yet another embodiment, output coupling flanges may be positioned end-to-end along either side of the luminaire, but staggered relative to corresponding luminaire modules so to ultimately stagger visible breaks defined between adjacent coupling flanges, and similar breaks defined between adjacent outer/inner flanges.

With reference now to FIG. 9, and in accordance with one embodiment, an assembled luminaire 900 is shown to take the form of an "X" recessed within a surface material 950, such as a false drywall ceiling or the like. Namely, a series of straight modules 952 are aligned and mounted at 90 degrees from one another and recessed within the surface material 950 to take the illustrated shape. As in the above examples, each module generally comprises a recessed housing (not shown) and an output assembly, such as output assembly 150 described above with reference to FIG. 1A, wherein an outer flange 960 provides for concealment of a gap formed between each housing and the surface material 950, and wherein a contiguous inner flange 999 provides partial concealment of a coupling flange (not explicitly shown). A singular seamless X-shaped output lens 958 is snapped into place, benefiting from similar advantages as described above with respect to other embodiments.

Similar embodiments may also benefit from other such luminaire patterns where sharp angled transitions are desired. For instance, the benefits of the above-described embodiments further extend to other angled luminaire formations or modules, which may include, but are not limited to, square (90 degree) angled corners, obtusely angled corners and/or acutely angled corners.

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. A luminaire comprising:

a housing having opposed side walls for housing one or more light sources therein;

an output element securable between inside surfaces of said side walls to extend along said housing at least partially defining a luminaire output pattern; and a resilient coupling flange extending at least partially along at least one inside surface of said side walls, said coupling flange having defined along a length thereof an output coupling structure adapted to laterally receive and resiliently secure an edge of said output element therein, said output coupling structure being inwardly biased so to be resiliently retractable and deployable in receiving and securing said edge therein.

2. The luminaire of claim 1, wherein an outer extremity of said output coupling structure defines a beveled edge such that application of an inward pressure by said output element edge against said beveled edge urges said output coupling structure to retract and resiliently redeploy upon said output element edge inwardly bypassing said beveled edge.

3. The luminaire of claim 1, wherein respective coupling flanges extend along either of said side walls.

4. The luminaire of any one of claim 1, wherein a coupling rail is defined along said at least one side wall to receive in sliding engagement therewith a correspondingly shaped flange coupling structure.

5. A luminaire comprising:

a housing having opposed side walls for housing one or more light sources therein;

an output element securable between inside surfaces of the side walls to extend along said housing at least partially defining a luminaire output pattern;

a resilient coupling flange extending at least partially along at least one of said inside surfaces of the side walls, said coupling flange having defined along a length thereof an output coupling structure adapted to laterally receive and resiliently secure an edge of said output element therein, said output coupling structure being inwardly biased so to be resiliently retractable and deployable in receiving and securing said edge therein;

a coupling rail is defined along said at least one inside surface of the side wall to receive in sliding engagement therewith a correspondingly shaped flange coupling structure;

wherein the luminaire further comprises a housing liner secured along an outer portion of said side wall, and wherein said coupling rail is defined along an inner portion of said housing liner.

6. The luminaire of claim 5, wherein said housing liner defines an inwardly projecting lateral flange along a length of said side wall that at least partially conceals a gap defined between an outer extremity of said coupling flange and said side wall.

7. The luminaire of claim 6, wherein said inwardly projecting flange extends no greater than ¼ inch from said side wall.

8. A luminaire comprising:

a housing having opposed side walls for housing one or more light sources therein;

an output element securable between inside surfaces of the side walls to extend along said housing at least partially defining a luminaire output pattern;

a resilient coupling flange extending at least partially along at least one of the inside surfaces of the side walls, said coupling flange having defined along a length thereof an output coupling structure adapted to laterally receive and resiliently secure an edge of said output element therein, said output coupling structure being inwardly biased so to be resiliently retractable and deployable in receiving and securing said edge therein; and wherein an inwardly projecting lateral flange is defined along a length of said side wall that at least partially conceals a gap defined between an outer extremity of said coupling flange and said side wall, and wherein said inwardly projecting flange extends no greater than ¼ inch from said side wall.

9. The luminaire of claim 1, wherein said output coupling structure is defined by a C-shaped hook at an outer extremity of said coupling flange, said hook having a lower edge-resting portion to receive said output element edge thereon, and an inwardly angled outer portion to secure said output element edge upon said edge-resting portion once received thereon.

10. The luminaire of claim 1, wherein said side walls are curved thereby defining a curved housing, said output element comprising a substantially flat arcuate element.

11. The luminaire of claim 1, wherein said housing is installable recessed within a correspondingly shaped aperture defined within a surface material, thereby rigidly fixing said side walls within said aperture prior to coupling of said output element, and wherein said coupling flange is sufficiently resilient to accommodate coupling of said output element thereto once said housing is recessed.

12. The luminaire of any one of claim 1, wherein said output element edge comprises a substantially flat edge.

13. A luminaire comprising:

a housing having opposed side walls for housing one or more light sources therein;

an output element securable between the inside surfaces of said side walls to extend along said housing at least partially defining a luminaire output pattern;

a resilient coupling flange extending at least partially along at least one of the inside surfaces of the side walls, said coupling flange having defined along a length thereof an output coupling structure adapted to laterally receive and resiliently secure an edge of said output element therein, said output coupling structure being inwardly biased so to be resiliently retractable and deployable in receiving and securing said edge therein;

a coupling rail is defined along said at least one side wall to receive in sliding engagement therewith a correspondingly shaped flange coupling structure; and wherein said coupling rail comprises a C-shaped rail, and wherein said flange coupling structure is defined by a bead correspondingly shaped for sliding engagement within said C-shaped rail.

14. A luminaire comprising:

a housing having opposed side walls for housing one or more light sources therein;

an output element securable between said inside surfaces of side walls to extend along said housing at least partially defining a luminaire output pattern;

a resilient coupling flange extending at least partially along at least one of the inside surfaces of the side walls, said coupling flange having defined along a length thereof an output coupling structure adapted to laterally receive and resiliently secure an edge of said output element therein, said output coupling structure being inwardly biased so to be resiliently retractable and deployable in receiving and securing said edge therein;

a coupling rail is defined along said at least one side wall to receive in sliding engagement therewith a correspondingly shaped flange coupling structure; and wherein said coupling rail comprises a T-shaped rail and wherein said flange coupling structure comprises a C-shaped structure correspondingly shaped for sliding engagement around said T-shaped rail.

15. The luminaire of claim 14, wherein said T-shaped rail defines an asymmetric cross-section beveled to inwardly bias said coupling flange upon engagement therewith.

16. A luminaire assembly for recessed installation within a correspondingly shaped aperture, comprising:

two or more luminaire modules mountable end-to-end within the aperture, each one of which comprising a recessable housing having opposed side walls;

an output element securable along and between inside surfaces of said side walls to at least partially define a luminaire output pattern; and opposed inwardly biased output coupling structures extending at least partially along respective inside surfaces of the side walls and adapted to receive and resiliently secure corresponding edges of said output elements along said side walls.

17. The luminaire assembly of claim 16, wherein said output coupling structures are defined at an outer extremity of respective coupling flanges extending along either of said side walls, wherein said coupling flanges are resiliently inwardly biased so to resiliently retract and deploy said coupling structures in securing said corresponding edges therein.

18. The luminaire assembly of claim 16, wherein said output element comprises a substantially flat element.

19. The luminaire assembly of claim 18, wherein at least one of said luminaire modules comprises a curved module, and wherein said output element comprises at least one correspondingly curved output element.

20. A luminaire assembly for recessed installation within a correspondingly shaped aperture, comprising:

two or more luminaire modules mountable end-to-end within the aperture, each one of which comprising a recessable housing having opposed side walls;

an output element securable along and between inside surfaces of the side walls to at least partially define a luminaire output pattern; and opposed inwardly biased output coupling structures extending at least partially along respective inside surfaces of the side walls and adapted to receive and resiliently secure corresponding edges of said output elements along said side walls;

said output element being a substantially flat element;

at least one of said luminaire modules defining a curved module, and wherein said output element defining at least one correspondingly curved output element; and wherein said output element comprises at least one seamless output element that is securable along and between said side walls of at least two contiguous luminaire modules, and wherein said at least two contiguous luminaire modules comprise said curved module.

* * * * *